US011452345B2

(12) United States Patent
Wan et al.

(10) Patent No.: US 11,452,345 B2
(45) Date of Patent: Sep. 27, 2022

(54) LUGGAGE ZIPPER LOCK AND LUGGAGE

(71) Applicant: Shanghai Gathey Science and Technology Development Co., Ltd, Shanghai (CN)

(72) Inventors: Tongzhou Wan, Shanghai (CN); Zhonghua Wu, Shanghai (CN)

(73) Assignee: SHANGHAI GATHEY SCIENCE AND TECHNOLOGY DEVELOPMENT CO., LTD, Shanghai (CN)

( * ) Notice: Subject to any disclaimer, the term of this patent is extended or adjusted under 35 U.S.C. 154(b) by 235 days.

(21) Appl. No.: 16/834,619

(22) Filed: Mar. 30, 2020

(65) Prior Publication Data

US 2020/0323314 A1 Oct. 15, 2020

(30) Foreign Application Priority Data

| | | |
|---|---|---|
| Apr. 10, 2019 | (CN) | 201910284957.6 |
| Apr. 10, 2019 | (CN) | 201920477665.X |
| Dec. 23, 2019 | (CN) | 201911338315.6 |
| Dec. 23, 2019 | (CN) | 201922330641.4 |

(51) Int. Cl.

| | |
|---|---|
| ***E05B 37/00*** | (2006.01) |
| ***A44B 19/30*** | (2006.01) |
| ***E05B 65/52*** | (2006.01) |
| ***E05B 37/02*** | (2006.01) |

(52) U.S. Cl.

CPC ..... *A44B 19/30* (2013.01); *E05B 37/02* (2013.01); *E05B 65/52* (2013.01)

(58) Field of Classification Search

CPC ..... E05B 37/00; E05B 37/02; E05B 65/52; A44B 19/30

USPC ..... 70/67–69

See application file for complete search history.

(56) References Cited

U.S. PATENT DOCUMENTS

| | | | | |
|---|---|---|---|---|
| 2,741,114 A * | 4/1956 | Poux | ..... | A44B 19/30 70/68 |
| 3,971,458 A * | 7/1976 | Koenig | ..... | A44B 19/301 190/120 |
| 4,271,689 A * | 6/1981 | Kasai | ..... | A44B 19/30 70/68 |

(Continued)

FOREIGN PATENT DOCUMENTS

| | | |
|---|---|---|
| CN | 201326305 Y | 10/2009 |
| CN | 203022465 U | 6/2013 |

(Continued)

*Primary Examiner* — Suzanne L Barrett

(74) *Attorney, Agent, or Firm* — Muncy, Geissler, Olds & Lowe, P C.

(57) ABSTRACT

A luggage zipper lock and a luggage, including a lock and a zipper, wherein the zipper includes a slider and a puller, the puller being provided on the slider, a first end of the slider is provided with a locking portion corresponding to the lock; when in a locked state, the locking portion on the slider is inserted into the lock and locked; when in an unlocked state, the lock is unlocked, and the locking portion on the slider can be pulled out from the lock. By moving the locked portion from the puller to the slider, the function of locking by pulling the slider is realized, which is simpler as compared to locking by buckling the puller into a lock hook, and the locking portion corresponds to the lock, so that only the zipper is pulled without making mistakes.

11 Claims, 15 Drawing Sheets

(56) References Cited

U.S. PATENT DOCUMENTS 4,350,375 A * 9/1982 Bako ..... A44B 19/301 24/386
4,884,419 A * 12/1989 Ling ..... A44B 19/301 70/4
5,031,944 A * 7/1991 Keyaki ..... A44B 19/301 292/307 R
5,063,760 A * 11/1991 Horita ..... E05B 37/02 70/23
5,103,657 A * 4/1992 Horita ..... A44B 19/301 70/68
6,029,482 A * 2/2000 Rifkin ..... A44B 19/301 109/43
6,062,051 A * 5/2000 Nam ..... A44B 19/301 70/68
6,510,593 B1 * 1/2003 Kim ..... A44B 19/301 24/382
8,307,518 B2 * 11/2012 Cheung ..... A44B 19/301 24/418
8,650,724 B2 * 2/2014 King ..... A45C 13/103 24/415
10,499,713 B2 * 12/2019 Huang ..... A44B 19/262
2004/0083782 A1 * 5/2004 Lantz ..... E05B 39/02 70/423
2005/0109072 A1 * 5/2005 Ling ..... E05B 37/02 70/68
2006/0162399 A1 7/2006 Yu
2009/0092343 A1 * 4/2009 Thomson ..... A45C 13/103 383/64
2010/0170306 A1 * 7/2010 Fong ..... E05B 37/02 70/57
2013/0036778 A1 2/2013 Lai

FOREIGN PATENT DOCUMENTS

CN 109236065 A 1/2019
CN 208347490 U 1/2019
CN 109854099 A 6/2019
DE 4106887 C2 6/2000

* cited by examiner

LUGGAGE ZIPPER LOCK AND LUGGAGE

BACKGROUND OF THE INVENTION

Field of the Invention

The disclosure belongs to the technical field of luggage, in particular, to a luggage zipper lock and a luggage.

Description of the Prior Art

A combination lock is a type of lock that uses a series of numbers or symbols when it is opened. A text combination lock can be divided into: a mechanical combination lock, a digital combination lock, and so on.

Passwords in a combination lock are usually just permutations rather than real combinations. Some combination locks only use a turntable to rotate several discs or cams in the lock. Also, some combination locks rotate a set of dial wheels engraved with numbers to directly drive the machinery inside the lock.

However, currently, the luggage locks on the market use the puller on the zipper to engage onto the luggage lock for locking, with a principle of inserting the holed part of the puller into the lock body such that the lock hook inside the lock body locking the puller. This kind of operation needs to find the lock holes, so for the user, the operation is tedious and it is easy to engage onto a wrong position.

SUMMARY OF THE INVENTION

The technical problem to be solved by the disclosure is to provide a luggage zipper lock and a luggage, so as to solve the problem of complex operations of the luggage and liability to engage onto a wrong position.

In order to solve the problem, the disclosure uses the following technical solution:

A luggage zipper lock of the disclosure includes a lock and a zipper, wherein the zipper includes a slider and a puller, the puller being provided on the slider, a first end of the slider is provided with a locking portion corresponding to the lock;

when in a locked state, the locking portion on the slider is inserted into the lock and locked;

when in an unlocked state, the lock is unlocked, and the locking portion on the slider may be pulled out from the lock.

For the luggage zipper lock of the disclosure, the lock is a combination lock, which further includes a locking/unlocking mechanism, and the locking/unlocking mechanism further includes a lock case, a lock hook pusher, at least one lock hook portion, and a combination lock mechanism; wherein the lock case is provided with a lock hole and a combination lock hole that correspond to the lock hook portions, the lock hole being used for inserting the lock portion of the zipper, the combination lock mechanism being provided in the combination lock hole;

the lock hook pusher, the lock hook portions and the combination lock mechanism are all provided in the lock case;

the lock hook pusher is connected to the combination lock mechanism, and the combination lock mechanism controls a relative movement of the lock hook pusher in the lock case;

the lock hook pusher is connected to each of the lock hook portions for defining a relative movement of each of the lock hook portions in the lock case, and each of the lock hook portions is respectively used to limit the locking portion inserted into the lock hole;

when in the locked state, the combination lock mechanism controls the lock hook pusher to make the lock hook in a locked position by contacting the lock hook pusher with each of the lock hook portions, and each of the lock hook portions respectively limits the lock portion inserted into the lock case;

when in the unlocked state, a digital password of the combination lock mechanism is correct, the combination lock mechanism controls the lock hook pusher to move, and the moving lock hook pusher does not contact with each of the lock hook portions, so that each of the lock hook portions is in an unlocked position, and each of the lock hook portions does not limit the locking portion inserted into the lock case.

For the luggage zipper lock of the disclosure, the combination lock mechanism includes a plurality of password disks, a plurality of password disk limit blocks, and a password disk shaft, wherein the password disk shaft is provided in the lock case; an inner ring of each of the plurality of password disks is connected correspondingly to a first end of each of the plurality of password disk limit blocks one by one, each of the plurality of password disks is fixed relative to the first end of each of the plurality of password disk limit blocks, and each of the plurality of password disks is provided with a plurality of grooves corresponding to numbers; each of the plurality of password disk limit blocks is opened with a through hole for the password disk shaft to pass through, and each of the plurality of password disk limit blocks is connected respectively to the password disk shaft through the through hole; each of the plurality of password disk limit blocks is provided with a notch;

the lock hook pusher is opened with a plurality of receiving holes for correspondingly receiving the plurality of password disks, each of the plurality of password disks penetrates through each of the plurality of receiving holes correspondingly, and the lock hook pusher is provided with a plurality of protrusions correspondingly, each of the plurality of protrusions of the lock hook pusher being capable of inserting into the notch on each of the plurality of password disk limit blocks correspondingly;

when in the unlocked state, the digital password of the combination lock mechanism is correct, the protrusions of the lock hook pusher are inserted into the notch on the password disk limit blocks, and the lock hook pusher is moved down.

For the luggage zipper lock of the disclosure, one end of the lock hook pusher is provided with the lock hook portion, or both ends of the lock hook pusher are provided relatively with the lock hook portion.

For the luggage zipper lock of the disclosure, the lock hook portion includes a lock hook, an end of the lock hook facing the lock hook pusher is provided with a limit notch, and an end of the lock hook pusher facing the limit notch is provided with a limit rod corresponding to the limit notch; when in the locked state, the limit rod is engaged in the limit notch, and the lock hook pusher limits a movement of the lock hook.

For the luggage zipper lock of the disclosure, an end of the lock hook facing the lock hole is opened with a locking notch, and the lock hook is engaged in the locking portion through the locking notch to lock the slider.

For the luggage zipper lock of the disclosure, the look hook includes a first locking block, a second locking block and a first transmission portion;

a first end of the first transmission portion is provided with the limit notch, and both sides of a second end of the first transmission portion are provided with a first slope and a second slope respectively; a first end of the first locking block is provided with a third slope corresponding to the first slope, a second end of the first locking block is provided with the locking notch for locking the locking portion, and the first locking block contacts with the first transmission portion through the first slope and the third slope; a first end of the second locking block is provided with a fourth slope corresponding to the second slope, a second end of the second locking block is provided with the locking notch for locking the locking portion, and the second locking block contacts with the first transmission portion through the second slope and the fourth slope.

For the luggage zipper lock of the disclosure, the lock hook portion further includes a spring, which has a first end connected to the lock hook and a second end fixed in the lock case, and the spring is used to provide a locking force to the lock hook for locking the locking portion.

For the luggage zipper lock of the disclosure, the luggage zipper lock further includes a customs lock, and the lock case is further provided with a customs lock hole; a lock core of the customs lock is provided in the customs lock hole, the lock core is connected to the lock hook pusher, and the lock core controls a relative movement of the look hook pusher in the lock case.

For the luggage zipper lock of the disclosure, the locking portion is a columnar protrusion provided at the first end of the slider; a first end of the locking portion is a spherical surface, and a second end of the locking portion is connected to the slider; the locking portion is provided with a locking groove corresponding to the lock hook portion.

A luggage of the disclosure is provided with the luggage zipper lock according to any one of the above; the luggage zipper lock is provided on the luggage, so that the luggage is locked by inserting the locking portion on the slider into the lock and locking.

Due to the adoption of the above technical solution, the disclosure has the following advantages and positive effects compared with the prior art:

In an embodiment of the disclosure, by providing a lock and a zipper, in which the zipper includes a slider and a puller, the puller is provided on the slider, and a first end of the slider is provided with a locking portion corresponding to the lock, the locking portion on the slider is inserted into the lock and locked when in a locked state, and the lock is unlocked and the locking portion on the slider can be pulled out from the lock when in an unlocked state. By moving the locked portion from the puller to the slider, the function of locking by pulling the slider is realized, which is simpler as compared to locking by buckling the puller into a lock hook, and the locking portion corresponds to the lock, so that only the zipper is pulled without making mistakes.

DESCRIPTION OF THE PREFERRED EMBODIMENTS

Figure 1:
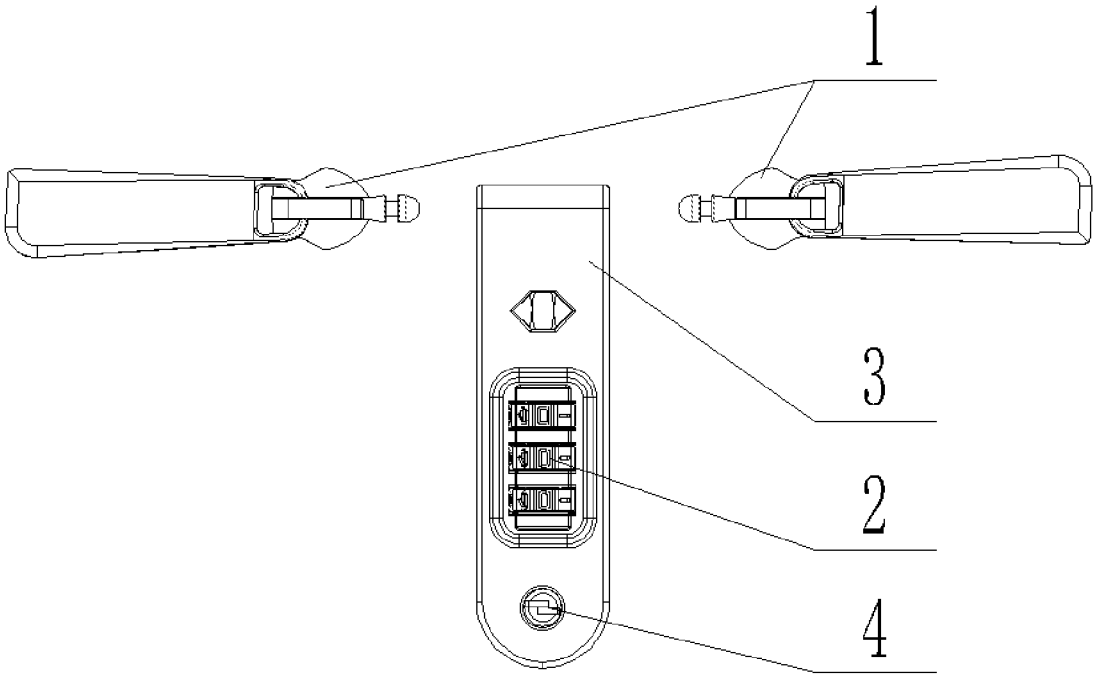
FIG. 1 is a view showing an unlocked state of a luggage zipper lock of the disclosure.
Figure 2:
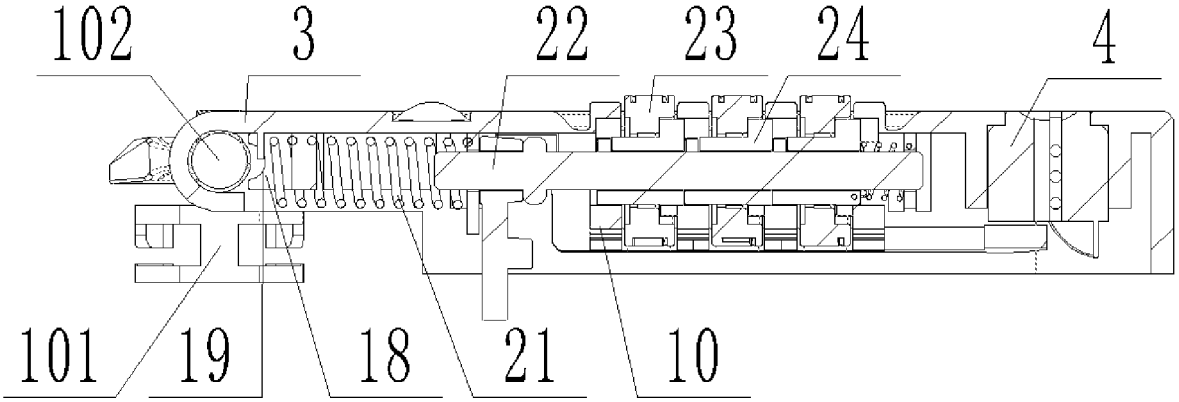
FIG. 2 is a cross-section view showing an unlocked state of a luggage zipper lock of the disclosure.
Figure 3:
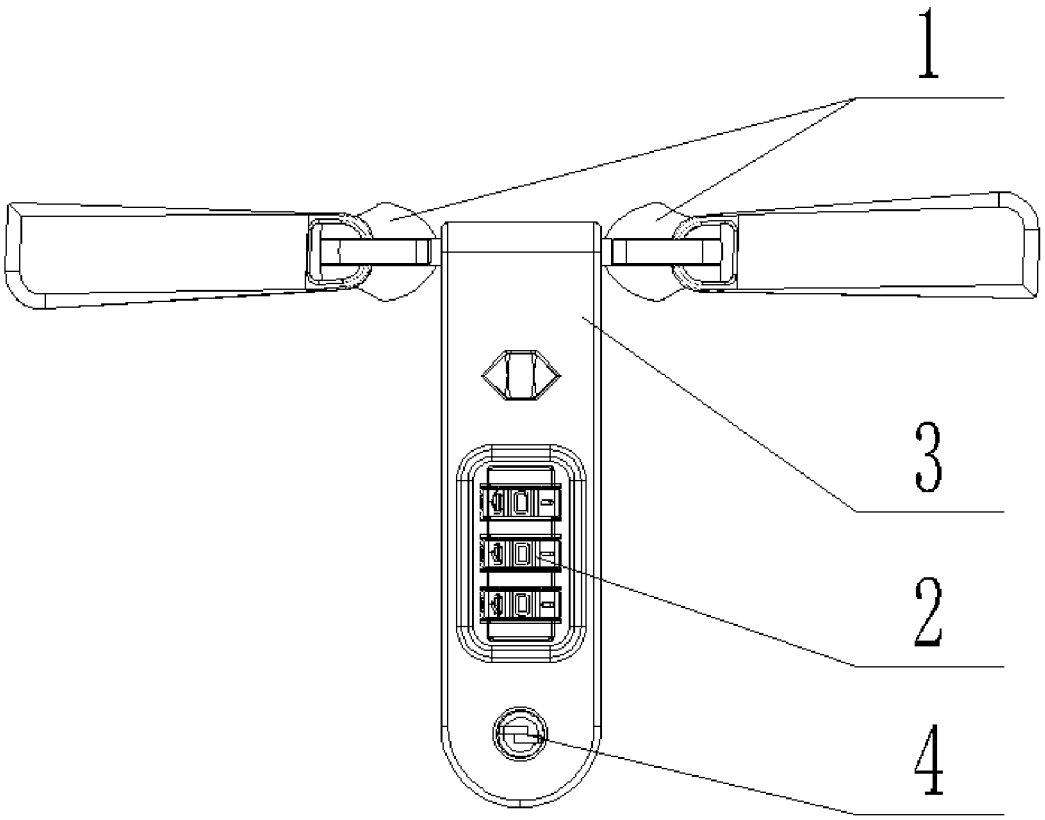
FIG. 3 is a view showing a locked state of a luggage zipper lock of the disclosure.
Figure 4:
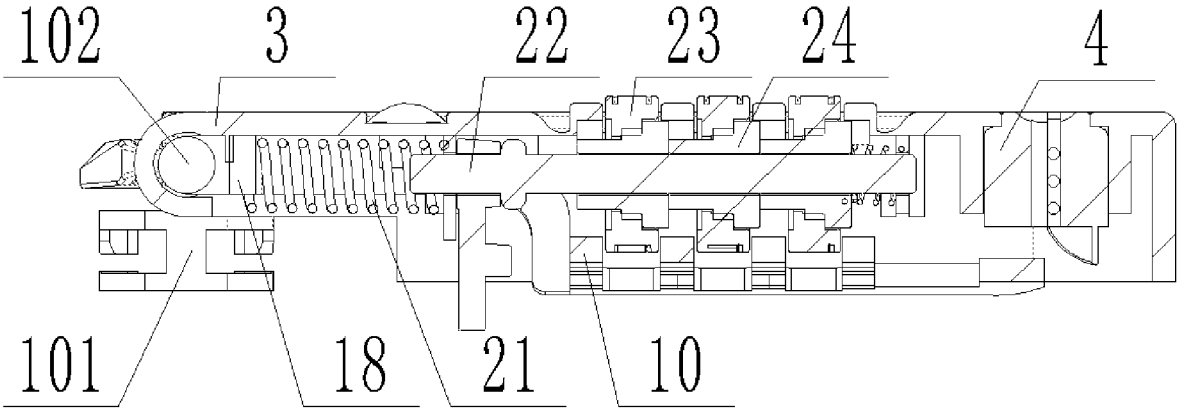
FIG. 4 is a section view showing a locked state of a luggage zipper lock of the disclosure.

Descriptions of reference numerals: 1 zipper; 101 slider; 102 locking portion; 103 puller; 104 locking groove; 2 combination lock mechanism; 21 spring; 22 password disk shaft; 23 password disk; 24 password disk limit block; 25 password disk spring tab; 26 password disk dial; 3 lock case; 4 customs lock; 5 first locking portion; 6 second locking portion; 7 first zipper; 71 first slider; 72 second slider; 8 second zipper; 81 third slider; 82 fourth slider; 9 first lock hook; 91 first transmission portion; 911 first slope; 912 second slope; 913 first limit notch; 92 first locking block; 921 third slope; 93 second locking block; 94 first locking notch; 10 lock hook pusher; 11 first lock hook pusher; 111 first limit rod; 12 second lock case; 13 second lock hook pusher; 131 second limit rod; 132 third limit rod; 14 second lock hook; 141 second transmission portion; 1411 fifth slope; 1412 sixth slope; 1413 second limit notch; 142 third locking block; 1421 seventh slope; 143 fourth locking block; 1431 eighth slope; 144 second locking notch; 15 third lock hook; 151 third transmission portion; 1511 ninth slope; 1512 tenth slope; 1513 third limit notch; 152 fifth locking block; 1521 eleventh slope; 153 sixth locking block; 1531 twelfth slope; 154 third locking notch; 16 receiving hole; 17 first lock case; 18 lock hook; 19 locking notch.

A luggage zipper lock and luggage proposed by the disclosure will be further described in detail below with reference to the drawings and specific embodiments. The advantages and features of the disclosure will be apparent from the following description and claims.

Embodiment 1

With reference to FIGS. 1 to 6, a luggage zipper lock includes a lock and a zipper 1, the zipper 1 including a slider 101 and a puller 103, the puller 103 being provided on the slider 101, a first end of the slider 101 being provided with a locking portion 102 (for example, the end of the slider 101 may be integrally formed with a locking portion 102). The lock is correspondingly provided with a lock hole, and the locking portion 102 on the slider 101 is inserted into the lock hole and locked when in a locked state, and the lock is unlocked and the locking portion 102 on the slider 101 may be pulled out from the lock hole when in an unlocked state. By moving the locked component from the puller 103 to the slider 101, the function of locking by pulling the slider 101 is realized, which is simpler as compared to locking by buckling the puller 103 into a lock hook 18, and the locking portion 102 corresponds to the lock hole, so that only the zipper i1 s pulled without making mistakes.

In the present embodiment, the lock is a combination lock, which further includes a locking/unlocking mechanism, and the locking/unlocking mechanism further includes a lock case 3, a lock hook pusher 10, a lock hook 18, and a combination lock mechanism 2. The lock case 3 is provided with a lock hole and a combination lock hole, the lock hole being used for inserting the lock portion 102 of the zipper 1, the combination lock mechanism 2 being provided in the combination lock hole. The lock hook pusher 10, the lock hook 18, and the combination lock mechanism 2 are all provided in the lock case 3. The lock hook pusher 10 is connected to the combination lock mechanism 2, and the combination lock mechanism 2 controls a relative movement of the lock hook pusher 10 in the lock case 3. A first end of the lock hook pusher 10 is connected to the lock hook 18 for defining a relative movement of the lock hook 18 in the lock case 3, and the lock hook 18 is used to limit the locking portion 102 of the zipper 1. At the same time, an inner space of the lock case 3 may limit the lock hook 18, and a travel direction of the lock hook 18 in the lock case 3 is unique, so as to avoid the situation where the lock hook 18 may not lock the locking portion 102.

When in the locked state, the combination lock mechanism 2 controls the lock hook pusher 10 to make the lock hook 18 in a locked position by contacting the lock hook pusher 10 with the lock hook 18, and the lock hook 18 limits the lock portion 102 inserted into the lock case 3.

When in the unlocked state, a digital password of the combination lock mechanism 2 is correct, the combination lock mechanism 2 controls the lock hook pusher 10 to move, and the moving lock hook pusher 10 does not contact with the lock hook 18, so that the lock hook 18 is in an unlocked position, and the lock hook 18 does not limit the locking portion 102 inserted into the lock case 3.

Among them, the combination lock mechanism 2 includes a plurality of password disks 23, a plurality of password disk limit blocks 24, and a password disk shaft 22. Among them, the password disk shaft 22 is provided in the lock case 3. An inner ring of the password disk 23 is sleeved with a first end of the password disk limit block 24, the password disk 23 is fixed relative to the password disk limit block 24, and the password disk 23 is provided with a plurality of grooves corresponding to numbers. The password disk limit block 24 is opened with a through hole for the password disk shaft 22 to pass through, and the password disk limit blocks 24 are all connected to the password disk shaft 22 through the through hole. The password disk shaft 22 is used as a limiter of the password disk limit block 24 to ensure that the password disk limit block 24 and the password disk 23 may only rotate around the password disk shaft 22 in the lock case 3 and may not move in other directions. The password disk limit block 24 is used to limit the position of the password disk 23, and the relative position between the password disk limit block 24 and the password disk 23 is fixed after being connected. A notch is provided on each of the password disk limit blocks 24, and the lock hook pusher 10 may slide in and out of the notch.

An end of the lock hook pusher 10 facing the lock hook 18 is provided with a limit rod, the lock hook pusher 10 is opened with a plurality of receiving holes 16 for receiving the plurality of password disks 23, the lock hook pusher 10 is sleeved on the password disk 23 through the receiving holes 16, and the lock hook pusher 10 is provided with a plurality of protrusions correspondingly, the plurality of protrusions of the lock hook pusher 10 being capable of inserting into the notch on the password disk limit blocks 24. An end of the lock hook 18 facing the lock hook pusher 10 is provided with a limit notch corresponding to the limit rod. And, an end of the lock hook 18 facing the lock hole is opened with a locking notch 19, and the lock hook 18 is engaged in a locking groove 104 on the locking portion 102 through the locking notch 19 to lock the locking portion 102. When unlocked, a digital password of the combination lock mechanism 2 is correct, the protrusions of the lock hook pusher 10 are inserted into the notch on the password disk limit block 24, the lock hook pusher 10 moves down, and the limit rod of the lock hook pusher 10 is removed from the limit notch of the lock hook 18, so that the lock hook pusher 10 no longer limits the lock hook 18, and then the lock hook 18 moves while the locking notch 19 sliding out of the locking groove 104 of the locking portion 102 to unlock the slider 101.

The locking/unlocking mechanism of the present embodiment achieves locking only by sliding the locking portion 102 on the slider 101 into the through hole on the lock case 3 with provisions of the lock case 3, and the lock hook pusher 10, lock hook 18, the combination lock mechanism 2 and the zipper 1 in the lock case 3, and provision of the locking portion 102 on the slider 101 of the zipper 1 while opening the lock case 3 with the through hole for the locking portion 102 to extend into. Among them, the combination lock is used as a replacement of a key, the combination lock mechanism 2 controls to move the lock hook pusher 10, and the lock hook pusher 10 further control the lock hook 18 to determine whether it is in the locked state; by moving the locked component from the puller 103 to the slider 101, the function of locking with the lock hook 18 by pulling the slider 101 is realized, which is simpler as compared to locking by buckling the puller 103 into a lock hook 18, and the locking portion 102 corresponds to the through hole on the lock case 3, so that only the zipper 1 is pulled without making mistakes. And, related to the locking/unlocking mechanism is the slider 101, and the locking portion 102 at the top of the slider 101 slides into the lock body to lock. Therefore, any impact will not affect the slider 101 and avoid the problem that the puller 103 outside the lock body is easily damaged by impact.

In the present embodiment, the locking/unlocking mechanism further includes a spring 21, the spring 21 having a first end connected to the lock hook 18, the spring 21 having a second end fixed in the lock case 3. A spring 21 is provided on the lock hook 18 to apply a spring force to the lock hook 18, so that in the locked state or in the unlocked state, the lock hook 18 may all have a certain degree of displacement such that the locking portion 102 of the slider 101 may push the lock hook 18 in the locked state and insert it into the lock hole to lock the zipper 1. Of course, the present embodiment is not limited to the spring 21, and the spring 21 may be replaced with other elastic elements having similar structures.

The spring 21 will exert the lock hook 18 a force toward the lock hole, so that the lock hook 18 is always in the locked position; when the locking portion 102 of the slider 101 is pushed into the lock hole, the locking portion 102 will push away the lock hook 18 and enter the lock hole, and the lock hook 18 engages with the locking portion 102 by the spring force of the spring 21 to achieve locking of the slider 101.

In the present embodiment, the combination lock mechanism 2 further includes a password disk spring tab 25, the password disk spring tab 25 being provided with a plurality of protrusions, and the plurality of protrusions of the password disk spring tab 25 are respectively inserted into the grooves of the password disk 23. The password disk spring tab 25 functions as maintaining the password disk 23 in a correct position when it is rotated, and enhance the use feel and positioning accuracy. The protrusions of the password disk spring tab 25 engage into the grooves of the password disk 23, and the grooves of the password disk 23 slides out of the password disk spring 25 when rotated, then slides into the next groove, and smoothly slides in under the elastic force of the spring tab.

In the present embodiment, the lock may further include a customs lock 4, and the lock case 3 is further provided with a customs lock hole, wherein a lock core of the customs lock 4 is provided in the customs lock hole, the lock core is connected to the lock hook pusher 10, and the lock core controls a relative movement of the look hook pusher 10 in the lock case 3. When the password is locked, the lock hook pusher 10 limits the lock hook 18. At this time, the lock core is rotated with the customs key, and the protrusions on the lock core lift the lock hook pusher 10 to move continuously until moving out of the limited region, at which time the limit of the lock hook 18 is invalid such that the slider 101 may be opened.

Figure 5:
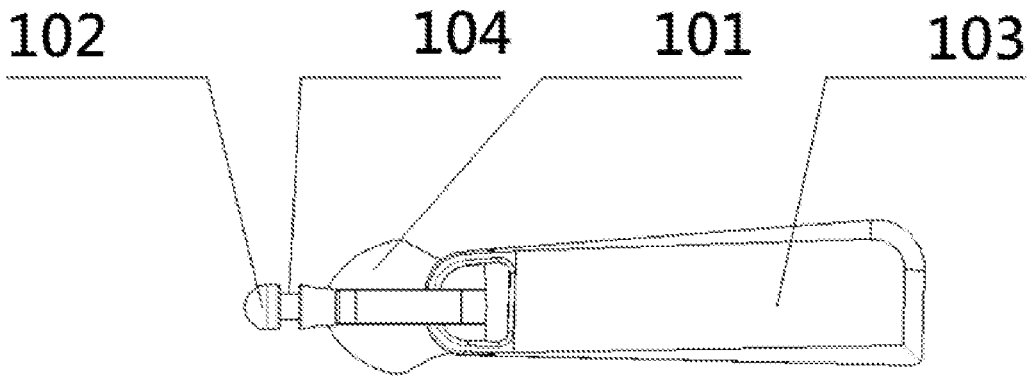
FIG. 5 is a view of a zipper of a luggage zipper lock of the disclosure.
Figure 6:
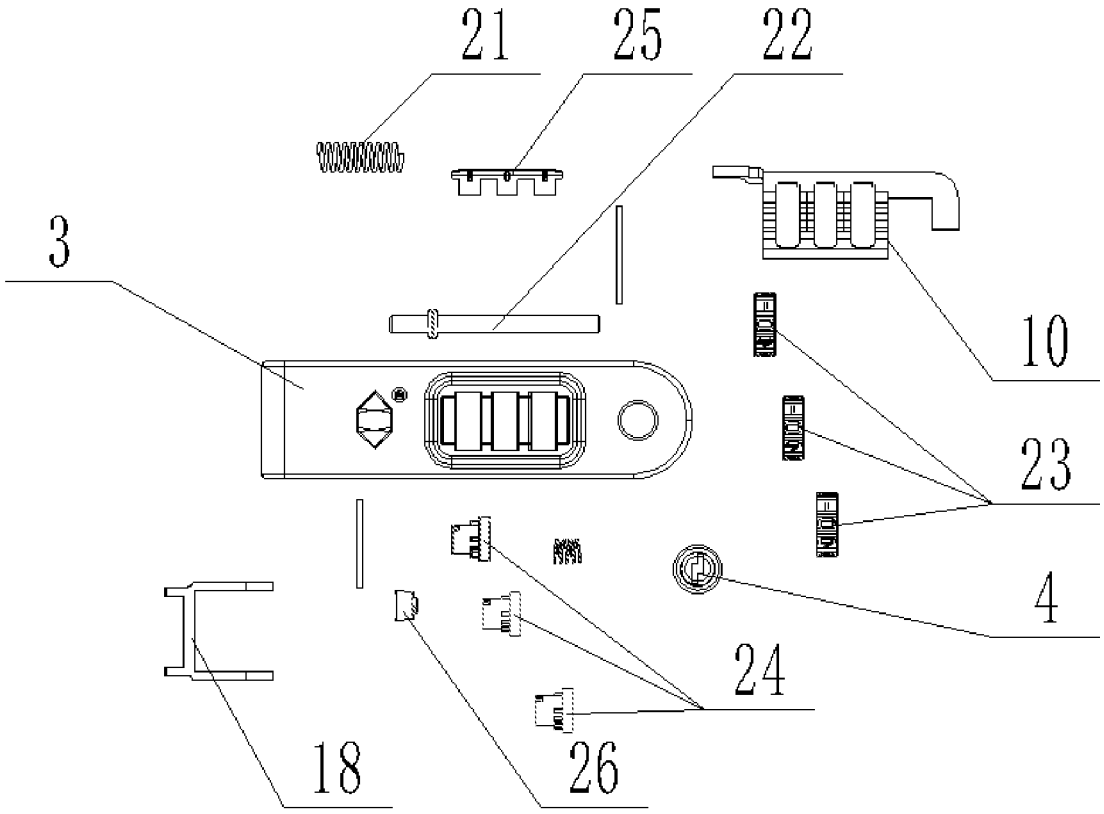
FIG. 6 is an exploded view of a luggage zipper lock of the disclosure.

In the present embodiment, with reference to FIG. 5, the locking portion 102 is a columnar protrusion provided at the first end of the slider 101. A first end of the locking portion 102 is a spherical surface, and a second end of the locking portion 102 is connected to the slider 101. The locking portion 102 is provided with a locking groove 104 corresponding to the lock hook 18. The locking groove 104 may be provided on the locking portion 102, and a groove may be formed at a joint between the locking portion 102 and the slider 101 as the locking groove 104.

In the present embodiment, the luggage zipper lock is fixed to the luggage body for use. Of course, in other embodiments, the luggage zipper lock may not fixed to the luggage body for use, and the locking may be completed as long as the locking portions 102 of the two zippers 1 are positioned in the lock case 3, so that the luggage may not be opened. This arrangement does not pose requirements on the locked position of the zipper 1. When the puller 103 is damaged due to violent factors, the user may find any item to replace the puller 103, for example, a rope may be used instead. This is because the portion to be locked is the slider 101, the role of the puller 103 is only to guide the sliding of the slider 101, avoiding the situation that the luggage may not be locked due to the damage of the puller 103.

If the password is required to change, the password disk dial 26 is pushed. At this time, engagement surfaces of three password disk limit blocks 24 slide out of the password disk 23, then a password required is changed, and then the password disk dial 26 is released such that the three password disk limit blocks 24 return to the inside of the password disk 23, and the teeth are engaged with the password disk 23, thereby achieving locking and completing the changing process.

Embodiment 2

Figure 7:
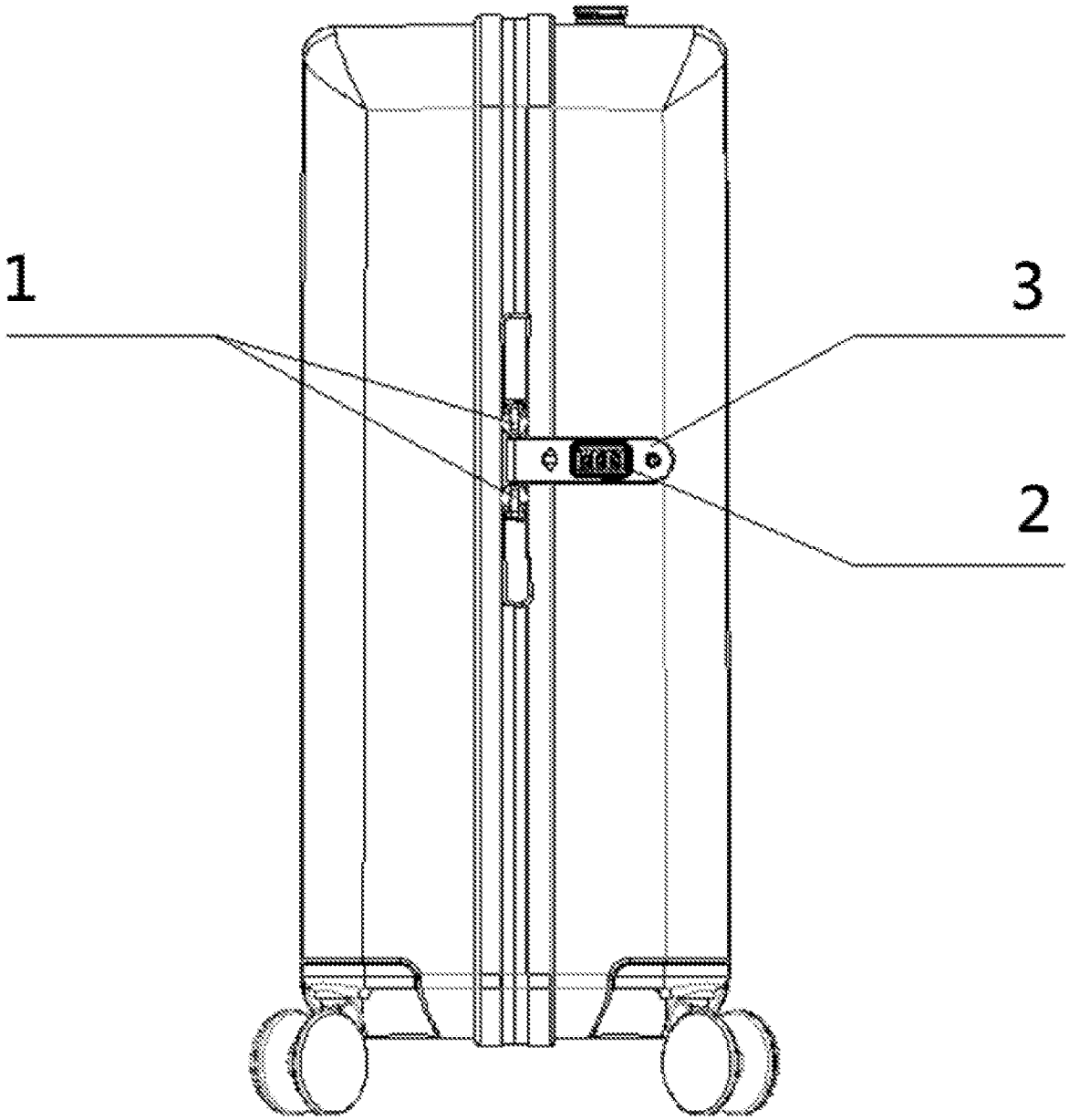
FIG. 7 is a view showing a locked state of a luggage of the disclosure.
Figure 8:
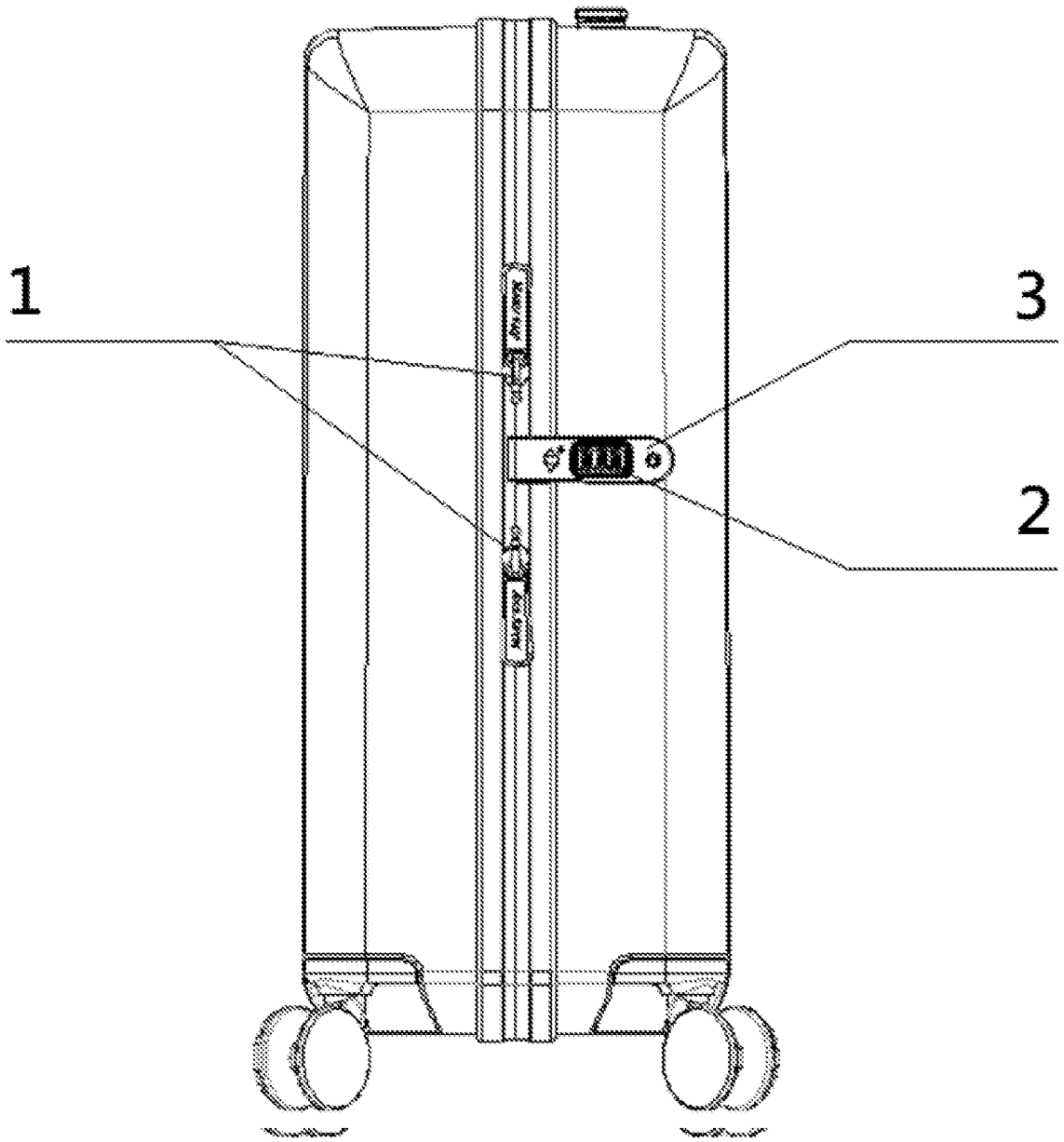
FIG. 8 is a view showing an unlocked state of a luggage of the disclosure.

With reference to FIGS. 7 and 8, a luggage is provided with the luggage zipper lock in the embodiment, wherein the zipper 1 of the luggage zipper lock is provided on the luggage, the lock case 3 may or may not be provided on the luggage body; with the provision of the luggage zipper lock, the function of locking with the lock hook 18 by pulling the slider 101 is realized, which is simpler as compared to locking by buckling the puller 103 into a lock hook 18, and the locking portion 102 corresponds to the through hole on the lock case 3, so that only the zipper 1 is pulled without making mistakes. Related to the lock is the slider 101, and the locking portion 102 at the top of the slider 101 slides into the lock body to lock. Therefore, any impact will not affect the slider 101 and avoid the problem that the puller 103 outside the lock body is easily damaged by impact. The lock may be or may not be fixed to the luggage body for use, and the locking may be completed as long as the locking portions 102 of the two zippers 1 are positioned in the lock case 3, so that the luggage may not be opened. In this way, no requirements may be imposed on the locked position of the zipper 1. When the puller 103 is damaged due to violent factors, the user may find any item to replace the puller 103, for example, a rope may be used instead. This is because the portion to be locked is the slider 101, the role of the puller 103 is only to guide the sliding of the slider 101.

Embodiment 3

A luggage zipper 1, the zipper 1 including a slider 101 and a puller 103, wherein the puller 103 is provided on the slider 101, and the slider 101 is provided with a locking portion 102 corresponding to the lock of the luggage.

Embodiment 4

A luggage lock, the luggage lock is provided with a fastening portion, the fastening portion matching with the locking portion 102 of the slider 101 of the luggage.

Embodiment 5

A luggage lock includes a zipper 1 and a lock, wherein the slider 101 of the zipper 1 is provided with a locking portion 102, and the lock is provided with a fastening portion corresponding to the locking portion 102. The locking portion 102 may be inserted into the fastening portion for fastening.

Embodiment 6

A luggage is provided with the luggage lock of Embodiment 5. For the luggage in the locked state, the locking portion 102 of the slider 101 is inserted into the fastening portion of the lock for fastening. On the luggage, the lock is arranged in a direction that matches with a pulling direction of the zipper 1, and the fastening portion is arranged in the pulling direction of the zipper 1, so that the locking portion 102 on the zipper 1 is inserted into the fastening portion of the lock and locked.

Embodiment 7

Figure 9:
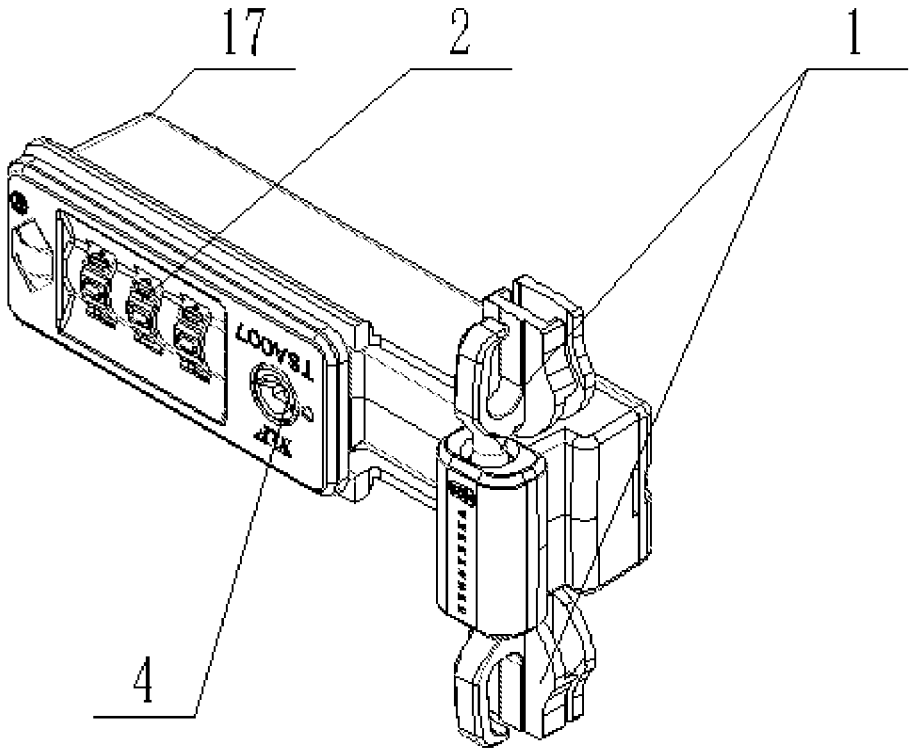
FIG. 9 is a view of a luggage zipper lock in Embodiment 7 of the disclosure.
Figure 10:
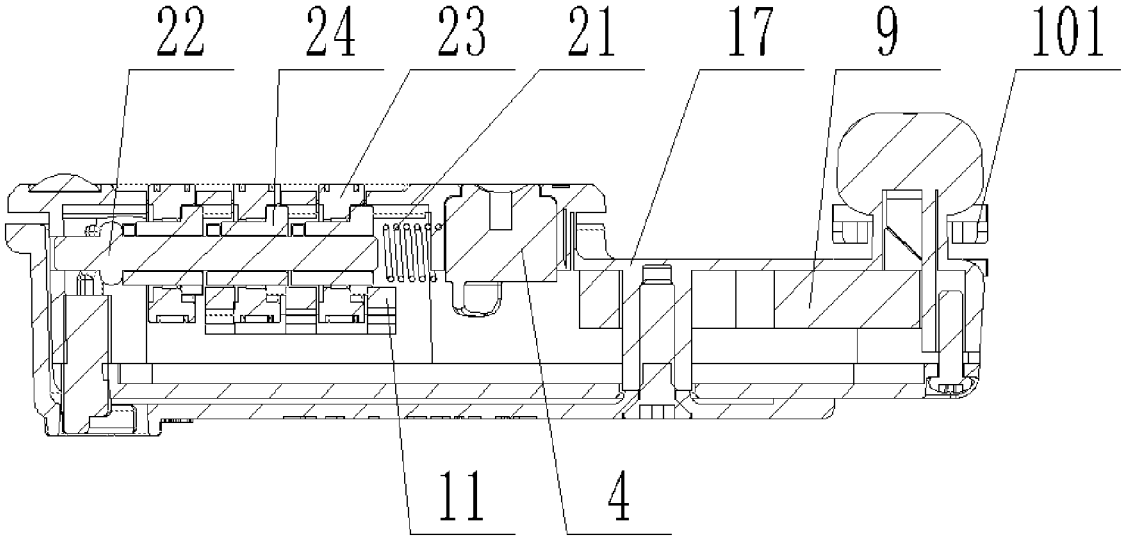
FIG. 10 is another view of a luggage zipper lock in Embodiment 7 of the disclosure.
Figure 11:
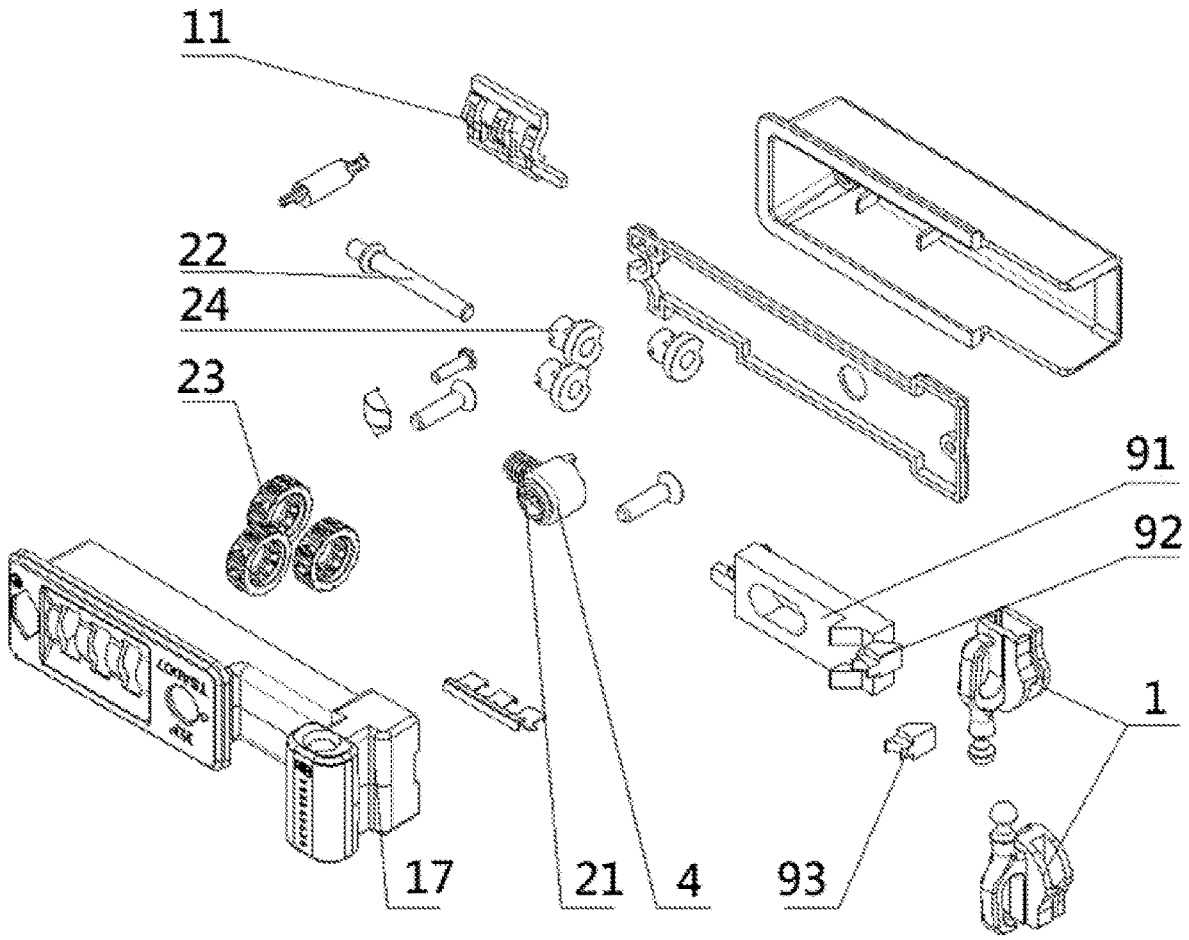
FIG. 11 is an exploded view of a luggage zipper lock in Embodiment 7 of the disclosure.

With reference to FIGS. 9 to 11, in the present embodiment, a luggage zipper lock includes a plurality of zippers 1 and a lock, and the sliders 101 of the zippers 1 are provided with locking portions 102. Among them, the lock is provided with a fastening portion corresponding to the lock hook 102. In the locked state, the locking portion on the slider 101 is inserted into the fastening portion and locked. In the unlocked state, the locking portion 102 is unlocked by the lock, and the locking portion 102 on the slider 101 may be pulled out of the fastening portion. By moving the locked component from the puller 103 to the slider 101, the function of locking by pulling the slider 101 is realized, which is simpler as compared to locking by buckling the puller 103 into a lock hook, and the locking portion 102 corresponds to the lock, so that only the zipper i1 s pulled without making mistakes.

In the present embodiment, the lock is a combination lock, which further includes a locking/unlocking mechanism, and the locking/unlocking mechanism further includes a first lock case 17, a first lock hook pusher 11, a first lock hook 9, and a combination lock mechanism 2. Both sides of one end of the first lock case 17 are provided with two lock holes oppositely provided, and the first lock case 17 is further provided with a combination lock hole, wherein the two lock holes are used to be inserted by the locking portions 102 of the two zippers 1, the combination lock mechanism 2 being provided in the combination lock hole. The first lock hook pusher 11, the first lock hook 9, and the combination lock mechanism 2 are all provided in the first lock case 17. The first lock hook pusher 11 is connected to the combination lock mechanism 2, and the combination lock mechanism 2 controls a relative movement of the first lock hook pusher 11 in the first lock case 17. A first end of the first lock hook pusher 11 is connected to the first lock hook 9 for defining a relative movement of the first lock hook 9 in the first lock case 17, and the first lock hook 9 is used to limit simultaneously the locking portions 102 of the two zippers 1 inserted into the lock holes. At the same time, an inner space of the first lock case 17 may limit the first lock hook 9, and a travel direction of the first lock hook 9 in the first lock case 17 is unique, so as to avoid the situation where the first lock hook 9 may not lock the locking portion 102.

When in the locked state, the combination lock mechanism 2 controls the first lock hook pusher 11 to make the first lock hook 9 in a locked position by contacting the first lock hook pusher 11 with the first lock hook 9, and the first lock hook 9 limits the lock portion 102 inserted into the first lock case 17.

When in the unlocked state, a digital password of the combination lock mechanism 2 is correct, the combination lock mechanism 2 controls the first lock hook pusher 11 to move, and the moving first lock hook pusher 11 does not contact with the first lock hook 9, so that the first lock hook 9 is in an unlocked position, and the first lock hook 9 does not limit the locking portion 102 inserted into the first lock case 17.

In the present embodiment, the combination lock mechanism 2 includes a plurality of password disks 23, a plurality of password disk limit blocks 24, and a password disk shaft 22. Among them, the password disk shaft 22 is provided in the first lock case 17. An inner ring of each of the password disks 23 is connected correspondingly with a first end of each of the password disk limit blocks 24 one by one, each of the password disks 23 is fixed relative to each of the password disk limit blocks 24, and each of the password disks 23 is provided with a plurality of grooves corresponding to numbers. Each of the password disk limit blocks 24 is opened with a through hole for the password disk shaft 22 to pass through, and each of the password disk limit blocks 24 is all connected to the password disk shaft 22 through the through hole. The password disk shaft 22 is used as a limiter of each of the password disk limit blocks 24 to ensure that each of the password disk limit blocks 24 and each of the password disks 23 may only rotate around the password disk shaft 22 in the first lock case 17 and may not move in other directions. Each of the password disk limit blocks 24 is used to limit the position of each of the respective password disks 23, and the relative position between each of the password disk limit blocs 24 and each of the password disks 23 is fixed after being connected. Each of the password disk limit blocs 24 is provided with a notch, and the notch is used for sliding the first lock hook pusher 11.

Figure 12:
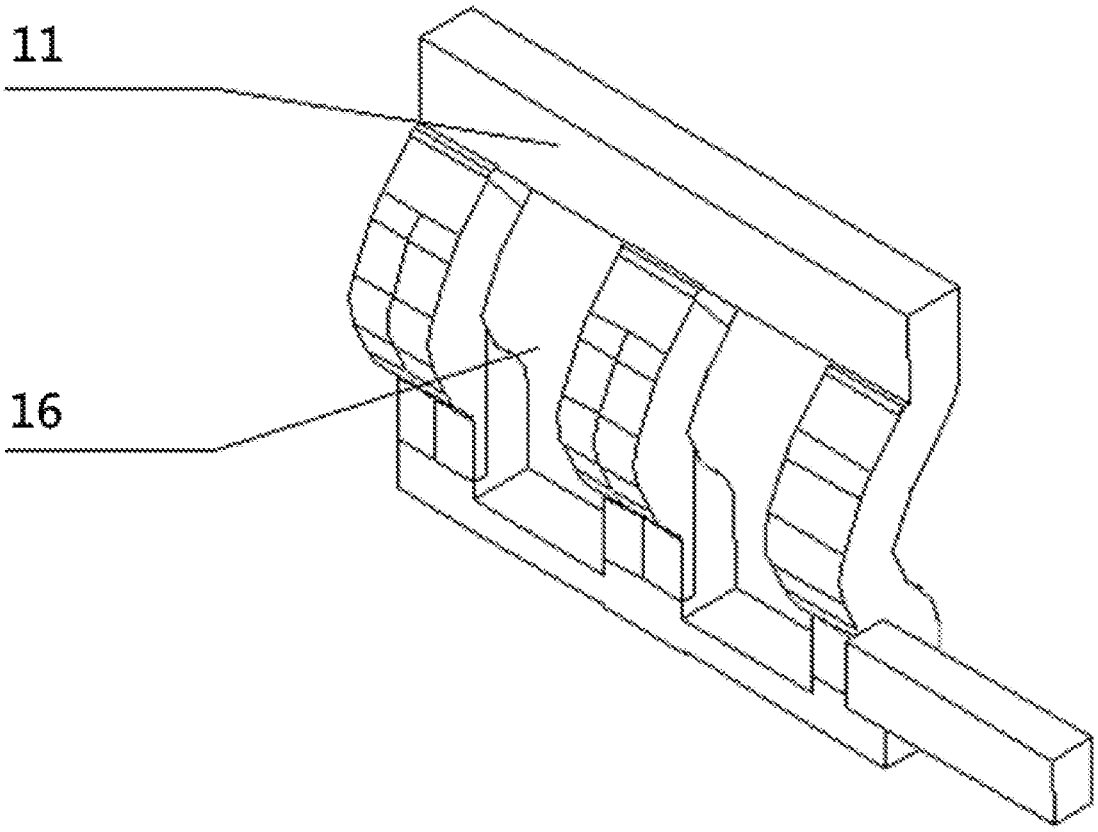
FIG. 12 is a view of a lock hook pusher in Embodiment 7 of the disclosure.

With reference to FIG. 12, an end of the first lock hook pusher 11 facing the first lock hook 9 is provided with a first limit rod 111, the first lock hook pusher 11 is opened with a plurality of receiving holes 16 for receiving the plurality of password disks 23, each of the password disks 23 penetrates correspondingly through each of the receiving holes 16, and the first lock hook pusher 11 is provided with a plurality of protrusions correspondingly, the plurality of protrusions of the first lock hook pusher 11 being capable of inserting into the notch on each of the password disk limit blocks 24. An end of the first lock hook 9 facing the first lock hook pusher 11 is provided with a first limit notch 913 corresponding to the first limit rod 111. And, an end of the first lock hook 9 is opened with a first locking notch 94; the locking portion 102 of the slider 101 extends into the lock hole, and is engaged by the first locking notch 94 of the first lock hook 9 in the lock hole. When unlocked, a digital password of the combination lock mechanism 2 is correct, the protrusions of the first lock hook pusher 11 are inserted into the notch on each of the password disk limit blocks 24, the first lock hook pusher 11 moves down, and the first limit rod 111 of the first lock hook pusher 11 is removed from the first limit notch 913 of the first lock hook 9, so that the first lock hook pusher 11 no longer limits the first lock hook 9, and then the first lock hook 9 moves while the first locking notch 94 sliding out of the locking groove 104 of the locking portion 102 to unlock the slider 101.

When in the unlocked state, a digital password of the combination lock mechanism 2 is correct, the protrusions of the first lock hook pusher 11 are inserted into the notch on the password disk limit block 24, the first lock hook pusher 11 moves down, the first limit 111 is detached from the first limit notch 913, and the first lock hook pusher 11 does not contact with the first lock hook 9, so that the first lock hook 9 is in an unlocked position, and the first lock hook 9 does not limit the locking portion 102 inserted into the first lock case 17.

When in the locked state, the digital password of the combination lock mechanism 2 is incorrect, the protrusions of the first lock hook pusher 11 are not inserted into the notch on the password disk limit block 24, the position of the first lock hook pusher 11 is limited, and the first limit rod 111 is engaged in the first limit notch 913, so that one end of the first limit rod 111 contacts with a side wall surface of the first limit notch 913, the first lock hook pusher 11 limits the movement of the first lock hook 9, the first lock hook 9 is in the locked state, and then the first lock hook 9 is engaged in the locking groove 104 on the locking portion 102 through the first locking notch 94 to lock the locking portion 102.

The locking/unlocking mechanism of the present embodiment achieves locking only by sliding the locking portion 102 on the slider 101 into the through hole on the first lock case 17 for locking, with provisions of the first lock case 17, and the first lock hook pusher 11, the first lock hook 9, the combination lock mechanism 2 and the zipper 1 in the lock case 17, and provision of the locking portion 102 on the slider 101 of the zipper 1 while opening the lock case 17 with the through hole for the locking portion 102 to extend into. Among them, the combination lock is used as a key, the combination lock controls to movement of the first lock hook pusher 11, so that the first lock hook pusher 11 further control the first lock hook 9 to determine whether it is in the locked state; by moving the locked component from the puller 103 to the slider 101, the function of locking with the first lock hook 9 by pulling the slider 101 is realized, which is simpler as compared to locking by buckling the puller 103 into the first lock hook 9, and the locking portion 102 corresponds to the through hole on the first lock case 17, so that only the zipper 1 is pulled without making mistakes. Related to the lock is the slider 101, and the locking portion 102 at the top of the slider 101 slides into the lock body to lock. Therefore, any impact will not affect the slider 101 and avoid the problem that the puller 103 outside the lock body is easily damaged by impact.

Figure 13:
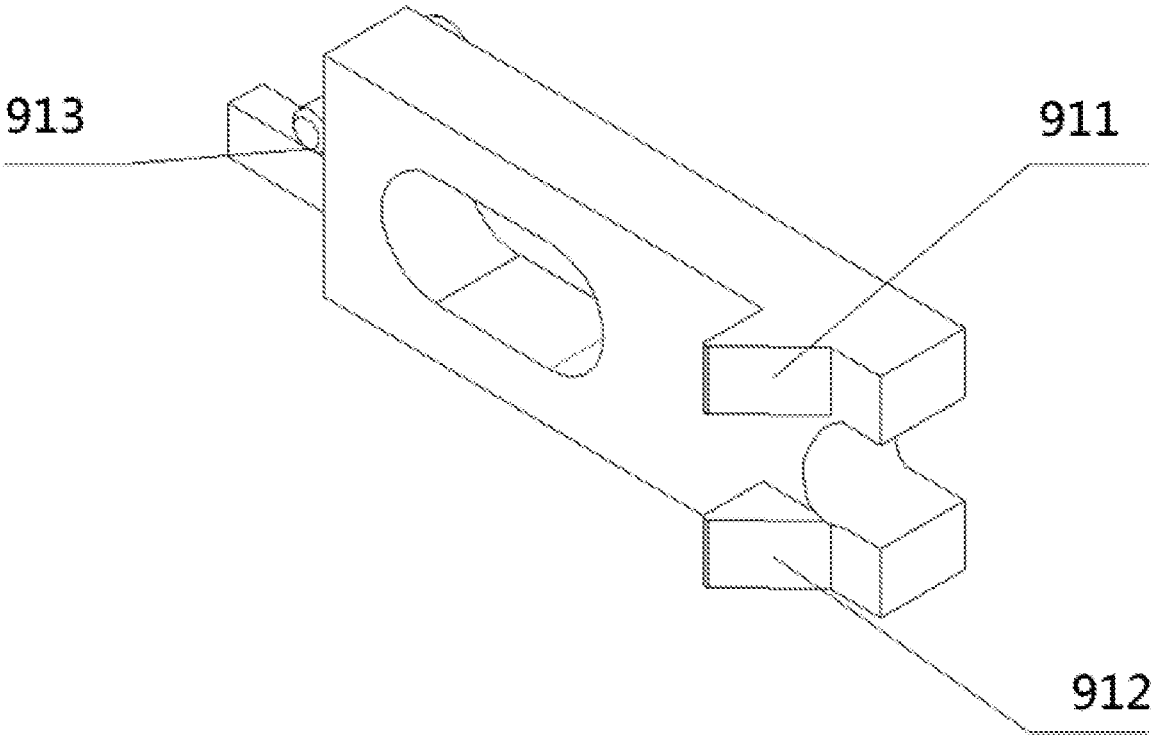
FIG. 13 is a view of a first transmission portion in Embodiment 7 of the disclosure.
Figure 14:
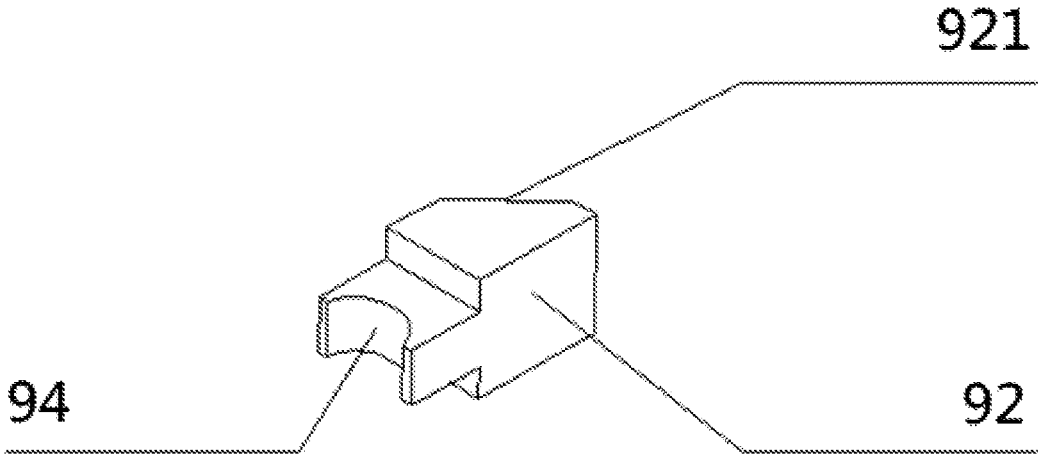
FIG. 14 is a view of a first locking block in Embodiment 7 of the disclosure.

In the present embodiment, with reference to FIGS. 13 and 14, the first lock hook 9 includes a first locking block 92, a second locking block 93 and a first transmission portion 91. When the first transmission portion 91 is mounted in the first lock case 17, its moving direction is limited by the first lock case 17, so that it may only move on its travel direction in the first lock case 17. A first end of the first transmission portion 91 is provided with the first limit notch 913, which is used to be connected to the first limit rod 111 of the first lock hook pusher 11; both ends of a second end of the first transmission portion 91 are provided respectively with a first slope 911 and a second slope 912 to form two inclined platforms on both sides of the second end of the first transmission portion 91. A first end of the first locking block 92 is provided with a third slope 921 corresponding to the first slope 911, and a second end of the first locking block 92 is provided with a first locking notch 94 for locking the locking portion 102. When the first locking block 92 is mounted in the first lock case 17, a moving direction of the first locking block 92 is limited by the first lock case 17, so that it may only move on its travel direction perpendicular to the first transmission portion 91 in the first lock case 17. The first locking block 92 and the first transmission portion 91 are connected to the third slope 921 through the first slope 911; when the first transmission portion 91 moves, the first locking block 92 is lifted or lowered through the cooperation of the first slope 911 and the third slope 921. A first end of the second locking block 93 is provided with a fourth slope corresponding to the second slope 912, and a second end of the second locking block 93 is provided with the first locking notch 94 for locking the locking portion 102. When the second locking block 92 is mounted in the first lock case 17, a moving direction of the second locking block 93 is limited by the first lock case 17, so that it may only move on its travel direction perpendicular to the first transmission portion 91 in the first lock case 17; the second locking block 93 and the first transmission portion 91 are connected to the fourth slope through the second slope 912, so that when the first transmission portion 91 moves, the second locking block 93 is lifted or lowered through the cooperation of the second slope 912 and the fourth slope. Through disposing the first locking block 92 and the second lock block 93 perpendicular to the first transmission portion 91, a lateral movement of the first transmission portion 91 is converted into a vertical movement of the first locking block 92 and the second locking block 93, so that the first locking block 92 and the second locking block 93 may lock the locking portion 102.

In the present embodiment, the locking/unlocking mechanism further includes a spring 21. A first end of the spring 21 is connected to the first transmission portion 91, and a second end of the spring 21 is fixed in the first lock case 17. In this way, in the locked state or in the unlocked state, the first transmission portion 91 may have a certain degree of displacement such that the locking portion 102 of the slider 101 may push the corresponding locking block in the locked state and insert it into the lock hole to lock the zipper 1. Of course, in other embodiments, the spring 21 may be another elastic element having a similar structure, which is not limited herein.

In the present embodiment, the combination lock mechanism 2 further includes a password disk spring tab 25, the password disk spring tab 25 being provided with a plurality of protrusions, and the plurality of protrusions of the password disk spring tab 25 are respectively provided in the grooves of the plurality of password disk 23. The password disk spring tab 25 functions as maintaining the password disk 23 in a correct position when it is rotated, and enhance the use feel and positioning accuracy. The protrusions of the password disk spring tab 25 engage into the grooves of the password disk 23, and the grooves of the password disk 23 slides out of the password disk spring 25 when rotated, then slides into the next groove, and smoothly slides in under the elastic force of the spring tab.

In the present embodiment, the locking portion 102 is a columnar protrusion provided at the first end of the slider 101. A first end of the locking portion 102 is a spherical surface, and a second end of the locking portion 102 is connected to the slider 101. The locking portion 102 is provided with a locking groove 104 corresponding to the first lock hook 9.

In the present embodiment, the luggage zipper lock is fixed to the luggage body for use. Of course, in other embodiments, the luggage zipper lock may not fixed to the luggage body for use, and the locking may be completed as long as the locking portions 102 of the two zippers 1 are positioned in the first lock case 17, so that the luggage may not be opened. In this way, no requirements may be imposed on the locked position of the zipper 1. When the puller 103 is damaged due to violent factors, the user may find any item to replace the puller 103, for example, a rope may be used instead. This is because the portion to be locked is the slider 101, the role of the puller 103 is only to guide the sliding of the slider 101.

If the password is required to change, the password disk dial 26 is pushed. At this time, engagement surfaces of three password disk limit blocks 24 slide out of the password disk 23, then a password required is changed, and then the password disk dial 26 is released such that the three password disk limit blocks 24 return to the inside of the password disk 23, and the teeth are engaged with the password disk 23, thereby achieving locking and completing the changing process.

Embodiment 8

With reference to FIGS. 9 to 11, in the present embodiment, a luggage is provided with the luggage zipper lock according to Embodiment 7. In the locked state, the locking portion 102 of the slider 101 is inserted into the fastening portion of the lock. By moving the locked component from the puller 103 to the slider 101, the function of locking by pulling the slider 101 is realized, which is simpler as compared to locking by buckling the puller 103 into the first lock hook 9, and the locking portion 102 corresponds to the lock, so that only the zipper i1 s pulled without making mistakes. Related to the lock is the slider 101, and the locking portion 102 at the top of the slider 101 slides into the lock body to lock. Therefore, any impact will not affect the slider 101 and avoid the problem that the puller 103 outside the lock body is easily damaged by impact. The lock may be or may not be fixed to the luggage body for use, and the locking may be completed as long as the locking portions 102 of the two zippers 1 are positioned in the first lock case 17, so that the luggage may not be opened. In this way, no requirements may be imposed on the locked position of the zipper 1. When the puller 103 is damaged due to violent factors, the user may find any item to replace the puller 103, for example, a rope may be used instead. This is because the portion to be locked is the slider 101, the role of the puller 103 is only to guide the sliding of the slider 101, avoiding the situation that the luggage may not be locked due to the damage of the puller 103.

Embodiment 9

Figure 15:
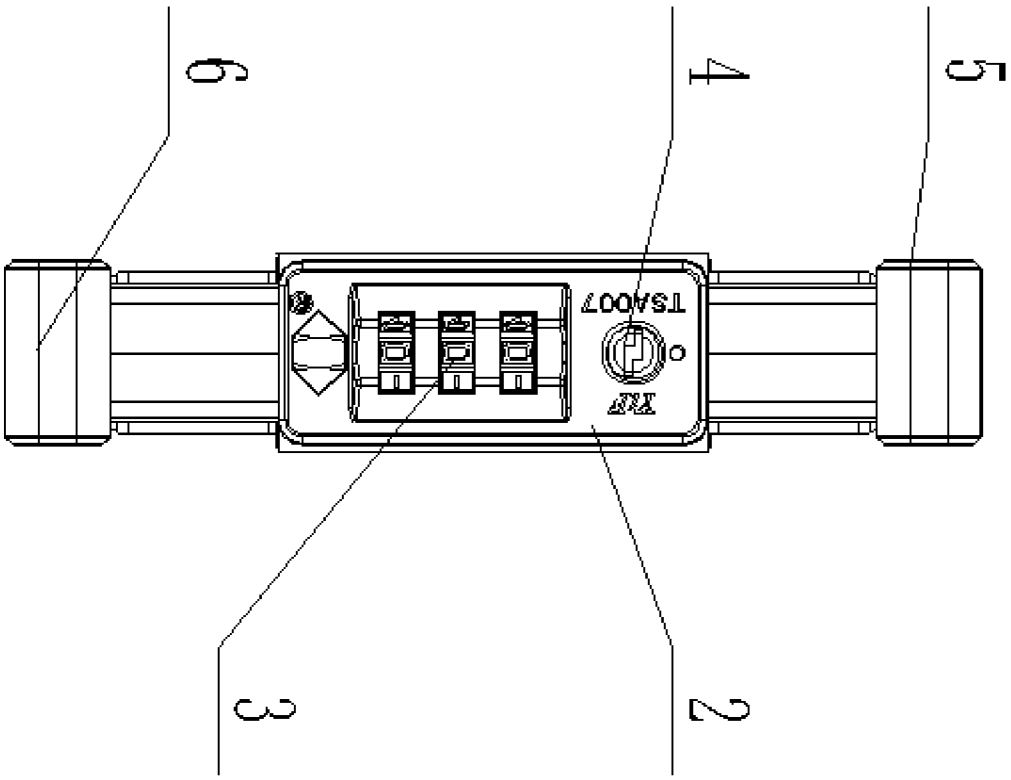
FIG. 15 is a view of a luggage zipper lock in Embodiment 9 of the disclosure.
Figure 16:
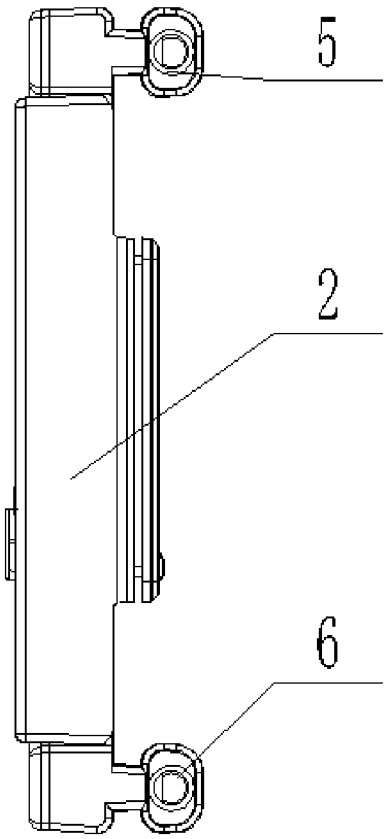
FIG. 16 is another view of a luggage zipper lock in Embodiment 9 of the disclosure.
Figure 17:
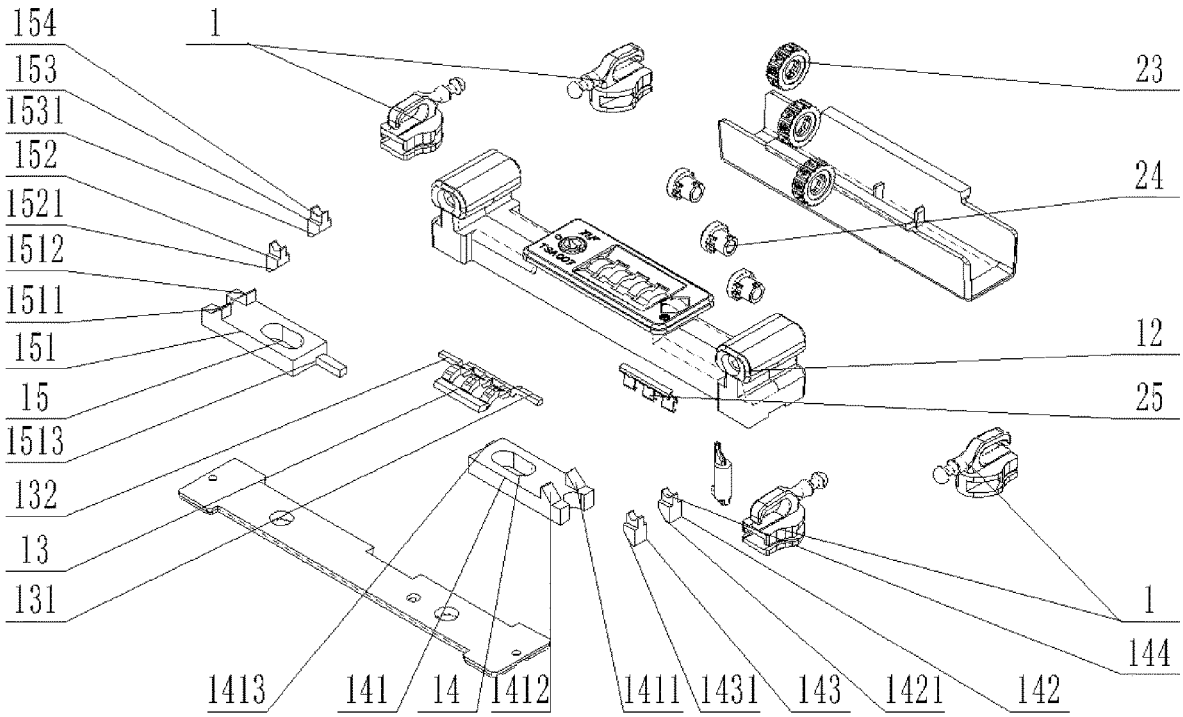
FIG. 17 is an exploded view of a luggage zipper lock in Embodiment 9 of the disclosure.

With reference to FIGS. 15, 16 to 17, in the present embodiment, a luggage zipper lock includes a plurality of zippers 1 and a lock, and first ends of the sliders 101 of the zippers 1 are provided with locking portions 102. Among them, the lock is a double-headed lock body, and both ends of the double-headed lock body are provided with a first fastening portion 5 and a second fastening portion 6 corresponding to the locking portion 102. In the locked state, the locking portions 102 on the sliders 101 are respectively inserted into the first fastening portion 5 and the second fastening portion 6, and locked. In the unlocked state, the double-headed lock body is unlocked, and the locking portions 102 on the plurality of sliders 101 are respectively pulled from the first fastening portion 5 and the second fastening portion 6. By moving the locked component from the puller 103 to the slider 101, the function of locking by pulling the slider 101 is realized, which is simpler as compared to locking by buckling the puller 103 into a lock hook 18, and the locking portion 102 corresponds to the lock, so that only the zipper 1 is pulled without making mistakes.

In the present embodiment, the double-headed lock body further includes a locking/unlocking mechanism, and the locking/unlocking mechanism further includes a second lock case 12, a second lock hook pusher 13, a second lock hook 14, a third lock hook 15 and a combination lock mechanism 2. Among them, both ends of the second lock case 12 are provided with two lock holes oppositely provided, and the second lock case 12 is further provided with a combination lock hole, wherein the four lock holes are used to be inserted and locked by the locking portions 102 of the zippers 1, the combination lock mechanism 2 being provided in the combination lock hole. The second lock hook pusher 13, the second lock hook 14, the third lock hook 15, and the combination lock mechanism 2 are all provided in the second lock case 12. The second lock hook pusher 13 is connected to the combination lock mechanism 2, and the combination lock mechanism 2 controls a relative movement of the second lock hook pusher 13 in the second lock case 12. Both ends of the second lock hook pusher 13 are connected to the second lock hook 14 and the third lock hook 15 for defining a relative movement of the second lock hook 14 and the third lock hook 15 in the second lock case 12, and the second lock hook 14 and the third lock hook 15 are respectively used to limit the zippers 1 inserted at both sides of the second lock case 12 into the lock holes. At the same time, an inner space of the second lock case 12 may limit the second lock hook 14 and the third lock hook 15, and travel directions of the second lock hook 14 and the third lock hook 15 in the second lock case 12 are unique, so as to avoid the situation where the second lock hook 14 and the third lock hook 15 may not lock the locking portion 102.

When in the locked state, the combination lock mechanism 2 controls the second lock hook pusher 13 to move, so that the second lock hook 14 and the third lock hook 15 are in a locked position by contacting the second lock hook pusher 13 with the second lock hook 14 and the third lock hook 15. At this time, the second lock hook 14 and the third lock hook 15 limits the locking portions 102 respectively inserted into the lock holes at both sides of the second lock case 12.

When in the unlocked state, a digital password of the combination lock mechanism 2 is correct, the combination lock mechanism 2 controls the second lock hook pusher 13 to move, and the moving second lock hook pusher 13 does not contact with the second lock hook 14 and the third lock hook 15, so that the second lock hook 14 and the third lock hook 15 are in an unlocked position, and the second lock hook 14 and the third lock hook 15 do not limit the locking portion 102 inserted into the second lock case 12.

In the present embodiment, the combination lock mechanism 2 includes a plurality of password disks 23, a plurality of password disk limit blocks 24, and a password disk shaft 22. Among them, the password disk shaft 22 is provided in the second lock case 12. An inner ring of each of the password disks 23 is connected correspondingly with a first end of each of the password disk limit blocks 24 one by one, each of the password disks 23 is fixed relative to each of the password disk limit blocks 24, and each of the password disks 23 is provided with a plurality of grooves corresponding to numbers. Each of the password disk limit blocks 24 is opened with a through hole for the password disk shaft 22 to pass through, and each of the password disk limit blocks 24 is all connected to the password disk shaft 22 through the through hole. The password disk shaft 22 is used as a limiter of each of the password disk limit blocks 24 to ensure that each of the password disk limit blocks 24 and each of the password disks 23 may only rotate around the password disk shaft 22 in the second lock case 12 and may not move in other directions. Each of the password disk limit blocks 24 is used to limit the position of each of the respective password disks 23, and the relative position between each of the password disk limit blocs 24 and each of the password disks 23 is fixed after being connected. Each of the password disk limit blocs 24 is provided with a notch, and the notch is used for sliding the second lock hook pusher 13.

Figure 18:
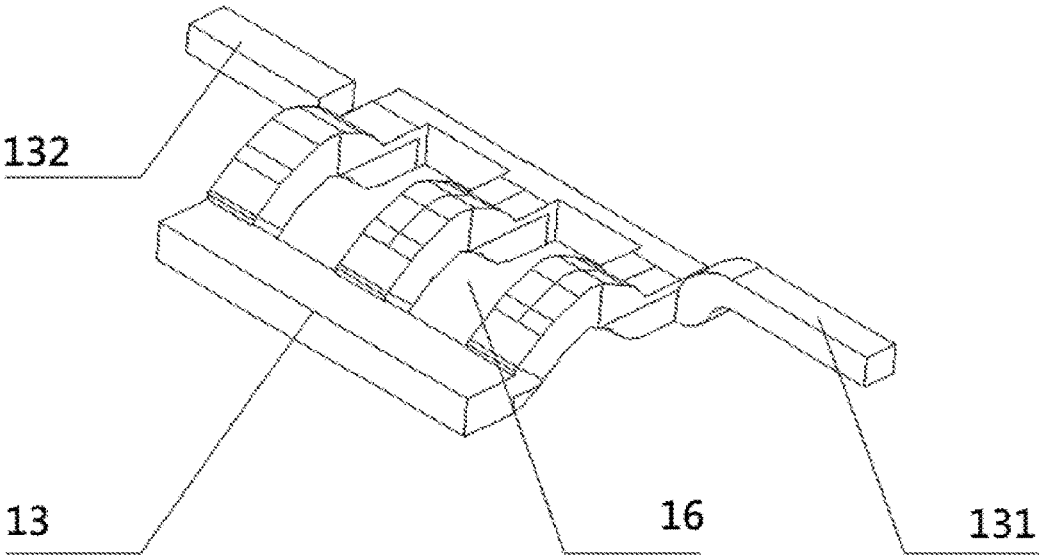
FIG. 18 is a view of a second lock hook pusher of a luggage zipper lock in Embodiment 9 of the disclosure.

In the present embodiment, with reference to FIG. 18, a first end of the second lock hook pusher 13 is provided with a second limit rod 131, and a second end of the second lock hook pusher 13 is provided with a third limit rod 132. The second lock hook pusher 13 is opened with a plurality of receiving holes 16 for receiving the plurality of password disks 23, each of the password disks 23 penetrates correspondingly through each of the receiving holes 16, and the second lock hook pusher 13 is provided with a plurality of protrusions correspondingly, the plurality of protrusions of the second lock hook pusher 13 being capable of inserting into the notch on the password disk limit blocks 24.

A first end of the second lock hook 14 is opened with a second locking notch 144; the locking portion 102 of the slider 101 extends into the lock hole, and is engaged by the second locking notch 144 of the second lock hook 14 in the lock hole. A second end of the second lock hook 14 is provided with a second limit notch 1413 corresponding to the second limit rod 131.

A first end of the third lock hook 15 is opened with a third locking notch 154; the locking portion 102 of the slider 101 extends into the lock hole, and is engaged by the third locking notch 154 of the third lock hook 15 in the lock hole. A second end of the third lock hook 15 is provided with a third limit notch 1513 corresponding to the third limit rod 132. The second locking notch 144 and the third locking notch 154 may be circular notches or square notches, as long as two arms formed by the notch may engage the locking portion 102 and limit the position.

In the unlocked state, a digital password of the combination lock mechanism 2 is correct, the protrusions of the second lock hook pusher 13 are inserted into the notch on the password disk limit block 24, the second lock hook pusher 13 moves down, the second limit 131 and the third limit rod 132 are respectively detached from the second limit notch 1413 and the third limit notch 1513, and the second lock hook pusher 13 does not contact with the second lock hook 14 and the third lock hook 15, so that the second lock hook 14 and the third lock hook 15 are in unlocked positions, and the second lock hook 14 and the third lock hook 15 do not limit the locking portions 102 respectively inserted into the second lock case 12.

In the locked state, the digital password of the combination lock mechanism 2 is incorrect, the protrusions of the second lock hook pusher 13 are not inserted into the notch on the password disk limit block 24, the position of the second lock hook pusher 13 is limited, and the second limit rod 131 and the third limit rod 132 are respectively engaged in the second limit notch 1413 and the third limit notch 1513, so that the second limit rod 131 and the third limit rod 132 contact respectively with side wall surfaces of the second lock hook 14 and the third lock hook 15, the second lock hook pusher 13 limits the movement of the second lock hook 14 and the third lock hook 15, the second lock hook 14 and the third lock hook 15 are in the locked states, and then the second lock hook 14 and the third lock hook 15 are engaged in the locking groove 104 on the locking portion 102 through the locking notches to lock the locking portion 102.

The locking/unlocking mechanism of the present embodiment achieves locking only by sliding the locking portion 102 on the slider 101 into the through hole on the second lock case 12, with provisions of the second lock case 12, and the second lock hook pusher 13, the second lock hook 14, the third lock hook 15, and the combination lock mechanism 2 in the second lock case 12, and provision of the locking portion 102 on the slider 101 of the zipper 1 while opening the second lock case 12 with the through hole for the locking portion 102 to extend into. Among them, the combination lock is used as a key, the combination lock controls to movement of the second lock hook pusher 13, so that the second lock hook pusher 13 further control the second lock hook 14 and the third lock hook 15 to determine whether it is in the locked state;

by moving the locked component from the puller 103 to the slider 101, the function of locking with the lock hook 18 by pulling the slider 101 is realized, which is simpler as compared to locking by buckling the puller 103 into the lock hook 18, and the locking portion 102 corresponds to the through hole on the second lock case 12, so that only the zipper 1 is pulled without making mistakes. Related to the lock is the slider 101, and the locking portion 102 at the top of the slider 101 slides into the lock body to lock. Therefore, any impact will not affect the slider 101 and avoid the problem that the puller 103 outside the lock body is easily damaged by impact.

Figure 19:
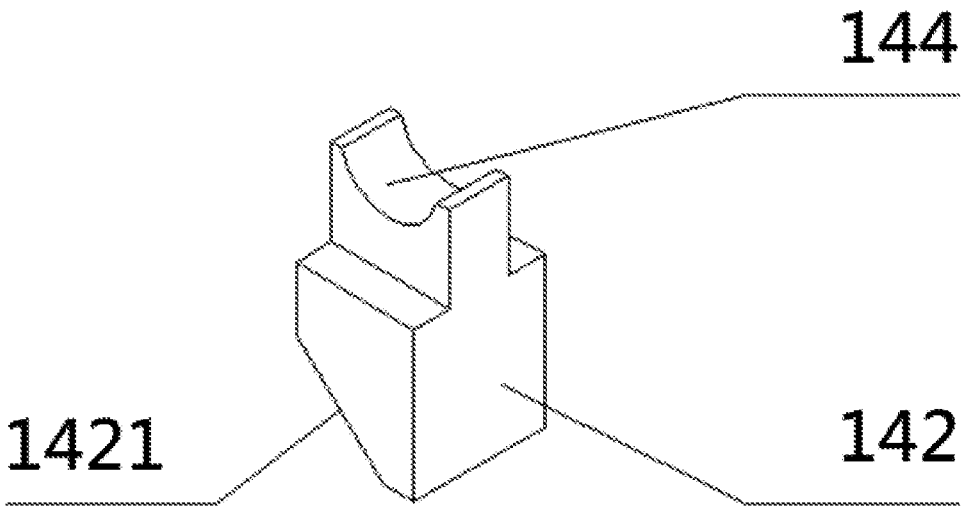
FIG. 19 is a view of a third locking block of a luggage zipper lock in Embodiment 9 of the disclosure.
Figure 20:
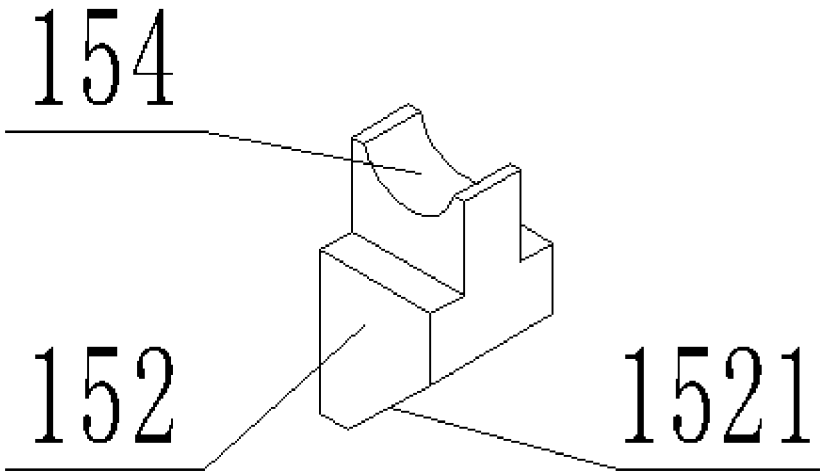
FIG. 20 is a view of a fifth locking block of a luggage zipper lock in Embodiment 9 of the disclosure.

In the present embodiment, with reference to FIGS. 19 and 20, the second lock hook 14 includes a third locking block 142, a fourth locking block 143 and a second transmission portion 141. When the second transmission portion 141 is mounted in the second lock case 12, its moving direction is limited by the second lock case 12, so that it may only move on its travel direction in the second lock case 12. A first end of the second transmission portion 141 is provided with the second limit notch 1413, which is used to be connected to the second limit rod 131 of the second lock hook pusher 13; both ends of a second end of the second transmission portion 141 are provided respectively with a fifth slope 1411 and a sixth slope 1412 to form two inclined platforms on both sides of the second end of the second transmission portion 141. A first end of the third locking block 142 is provided with a seventh slope 1421 corresponding to the fifth slope 1411, and a second end of the third locking block 142 is provided with a second locking notch 144 for locking the locking portion 102. When the third locking block 142 is mounted in the second lock case 12, a moving direction of the third locking block 142 is limited by the second lock case 12, so that it may only move on its travel direction perpendicular to the second transmission portion 141 in the second lock case 12. The third locking block 142 and the second transmission portion 141 are connected to the seventh slope 1421 through the fifth slope 1411; when the second transmission portion 141 moves, the third locking block 142 is lifted or lowered through the cooperation of the fifth slope 1411 and the seventh slope 1421. A first end of the fourth locking block 143 is provided with an eighth slope 1431 corresponding to the sixth slope 1412, and a second end of the fourth locking block 143 is provided with the second locking notch 144 for locking the locking portion 102. When the fourth locking block 14392 is mounted in the second lock case 12, a moving direction of the fourth locking block 143 is limited by the second lock case 12, so that it may only move on its travel direction perpendicular to the second transmission portion 141 in the second lock case 12; the fourth locking block 143 and the second transmission portion 141 are connected to the eighth slope 1431 through the sixth slope 1412, so that when the second transmission portion 141 moves, the fourth locking block 143 is lifted or lowered through the cooperation of the sixth slope 1412 and the eighth slope 1431. Through disposing the third locking block 142 and the fourth lock block 143 perpendicular to the second transmission portion 141, a lateral movement of the second transmission portion 141 is converted into a vertical movement of the third locking block 142 and the fourth locking block 143, so that the third locking block 142 and the fourth locking block 143 may lock the locking portion 102.

The third lock hook 15 includes a fifth locking block 152, a sixth locking block 153 and a third transmission portion 151. When the third transmission portion 151 is mounted in the second lock case 12, its moving direction is limited by the second lock case 12, so that it may only move on its travel direction in the second lock case 12. A first end of the third transmission portion 151 is provided with the third limit notch 1513, which is used to be connected to the third limit rod 132 of the second lock hook pusher 13; both ends of a second end of the third transmission portion 151 are provided respectively with a ninth slope 1511 and a tenth slope 1512 to form two inclined platforms on both sides of the second end of the third transmission portion 151. A first end of the fifth locking block 152 is provided with an eleventh slope 1521 corresponding to the ninth slope 1511, and a second end of the fifth locking block 152 is provided with a third locking notch 154 for locking the locking portion 102. When the fifth locking block 152 is mounted in the second lock case 12, a moving direction of the fifth locking block 152 is limited by the second lock case 12, so that it may only move on its travel direction perpendicular to the third transmission portion 151 in the second lock case 12. The fifth locking block 152 and the third transmission portion 151 are connected to the eleventh slope 1521 through the ninth slope 1511; when the third transmission portion 151 moves, the fifth locking block 152 is lifted or lowered through the cooperation of the ninth slope 1511 and the eleventh slope 1521. A first end of the sixth locking block 153 is provided with an twelfth slope 1531 corresponding to the tenth slope 1512, and a second end of the sixth locking block 153 is provided with the third locking notch 154 for locking the locking portion 102. When the sixth locking block 153 is mounted in the second lock case 12, a moving direction of the sixth locking block 153 is limited by the second lock case 12, so that it may only move on its travel direction perpendicular to the third transmission portion 151 in the second lock case 12; the sixth locking block 153 and the third transmission portion 151 are connected to the twelfth slope 1531 through the tenth slope 1512, so that when the third transmission portion 151 moves, the sixth locking block 153 is lifted or lowered through the cooperation of the tenth slope 1512 and the twelfth slope 1531. Through disposing the fifth locking block 152 and the sixth lock block 153 perpendicular to the third transmission portion 151, a lateral movement of the third transmission portion 151 is converted into a vertical movement of the fifth locking block 152 and the sixth locking block 153, so that the fifth locking block 152 and the sixth locking block 153 may lock the locking portion 102.

In the present embodiment, the locking/unlocking mechanism further includes a first spring and a second spring. A first end of the first spring is connected to the second transmission portion 141, and a second end of the first spring is fixed in the second lock case 12. A first end of the second spring is connected to the third transmission portion 151, and a second end of the second spring is fixed in the second lock case 12. In this way, in the locked state or in the unlocked state, the second transmission portion 141 and the third transmission portion 151 may have a certain degree of displacement such that the locking portion 102 of the slider 101 may push the corresponding locking block in the locked state and insert it into the lock hole to lock the zipper 1. Of course, in other embodiments, the spring may be another elastic element having a similar structure, which is not limited herein.

In the present embodiment, the combination lock mechanism 2 further includes a password disk spring tab 25, the password disk spring tab 25 being provided with a plurality of protrusions, and the plurality of protrusions of the password disk spring tab 25 are respectively inserted into the grooves of the password disk 23. The password disk spring tab 25 functions as maintaining the password disk 23 in a correct position when it is rotated, and enhance the use feel and positioning accuracy. The protrusions of the password disk spring tab 25 engage into the grooves of the password disk 23, and the grooves of the password disk 23 slides out of the password disk spring 25 when rotated, then slides into the next groove, and smoothly slides in under the elastic force of the spring tab.

In the present embodiment, the locking portion 102 is a columnar protrusion provided at the first end of the slider 101. A first end of the locking portion 102 is a spherical surface, and a second end of the locking portion 102 is connected to the slider 101. The locking portion 102 is provided with a locking groove 104 corresponding to the lock hook 18.

In the present embodiment, the luggage zipper lock is fixed to the luggage body for use. Of course, in other embodiments, the luggage zipper lock may not fixed to the luggage body for use, and the locking may be completed as long as the locking portions 102 of the two zippers 1 are positioned in the second lock case 12, so that the luggage may not be opened. In this way, no requirements may be imposed on the locked position of the zipper 1. When the puller 103 is damaged due to violent factors, the user may find any item to replace the puller 103, for example, a rope may be used instead. This is because the portion to be locked is the slider 101, the role of the puller 103 is only to guide the sliding of the slider 101.

If the password is required to change, the password disk dial 26 is pushed. At this time, engagement surfaces of three password disk limit blocks 24 slide out of the password disk 23, then a password required is changed, and then the password disk dial 26 is released such that the three password disk limit blocks 24 return to the inside of the password disk 23, and the teeth are engaged with the password disk 23, thereby achieving locking and completing the changing process.

Embodiment 10

Figure 21:
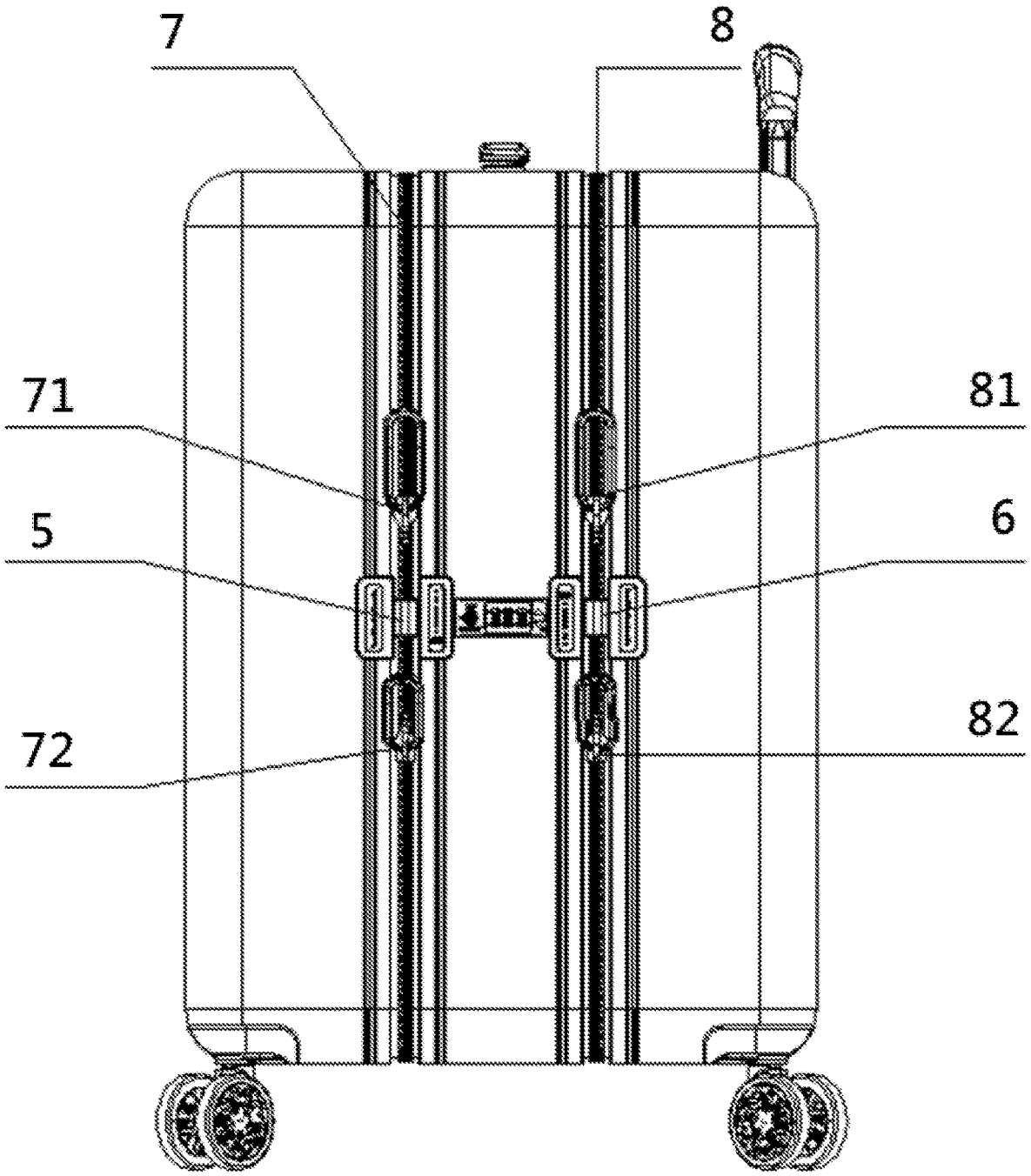
FIG. 21 is a view showing an opened state of a luggage in Embodiment 10 of the disclosure.
Figure 22:
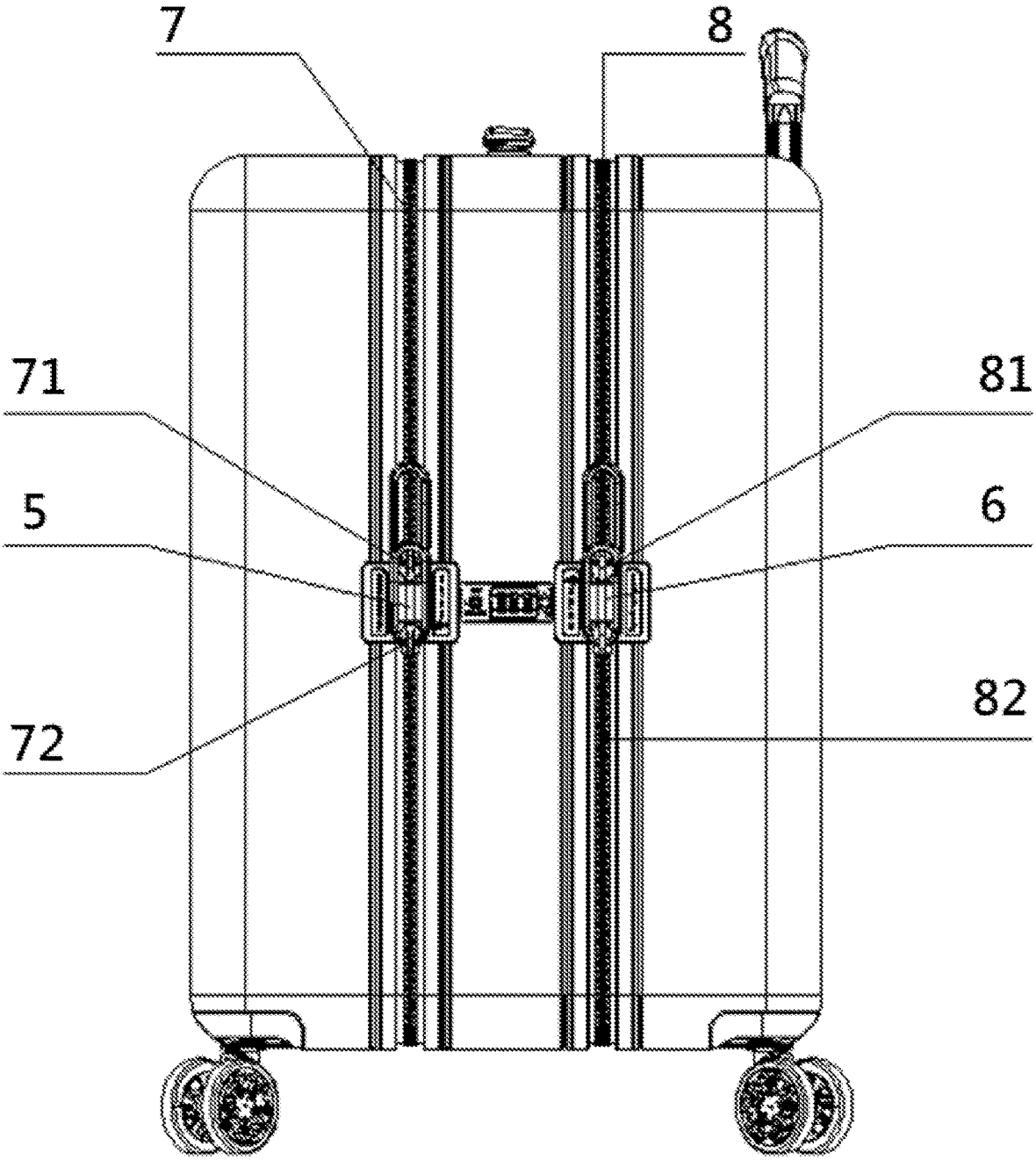
FIG. 22 is a view showing a locked state of a luggage in Embodiment 10 of the disclosure.

With reference to FIGS. 21 to 22, a luggage is provided with the luggage zipper lock according to any one of Embodiment 9. It further includes a first luggage body, a second luggage body and an intermediate luggage body. The plurality of zippers 1 are a first zipper 7 and a second zipper 8. First sides of the first luggage body and the intermediate luggage body are connected with each other through the first zipper 7, and the first zipper 7 includes a first slider 71 and a second slider 72. Second sides of the second luggage body and the intermediate luggage body are connected with each other through the second zipper 8, and the second zipper 8 includes a third slider 81 and a fourth slider 82. The double-headed lock body is provided on the intermediate luggage body. The first slider 71 and the second slider 72 correspond to the first locking portion 5. The third slider 81 and the fourth slider 82 correspond to the second locking portion 6.

By moving the locked component from the puller 103 to the slider 101, the function of locking by pulling the slider 101 is realized, which is simpler as compared to locking by buckling the puller 103 into a lock hook 18, and the locking portion 102 corresponds to the lock, so that only the zipper 1 is pulled without making mistakes. Related to the lock is the slider 101, and the locking portion 102 at the top of the slider 101 slides into the lock body to lock. Therefore, any impact will not affect the slider 101 and avoid the problem that the puller 103 outside the lock body is easily damaged by impact. The luggage lock may be or may not be fixed to the luggage body for use, and the locking may be completed as long as the locking portions 102 of the two zippers 1 are positioned in the second lock case 12, so that the luggage may not be opened. In this way, no requirements may be imposed on the locked position of the zipper 1. When the puller 103 is damaged due to violent factors, the user may find any item to replace the puller 103, for example, a rope may be used instead. This is because the portion to be locked is the slider 101, the role of the puller 103 is only to guide the sliding of the slider 101, avoiding the situation that the luggage may not be locked due to the damage of the puller 103.

The embodiments of the disclosure have been described in detail above with reference to the drawings, but the disclosure is not limited to the above embodiments. Even if various changes are made to the disclosure, if these changes fall within the scope of the claims of the disclosure and their equivalent technologies, they still fall within the protection scope of the disclosure.

What is claimed is:

1. A luggage zipper lock, comprising a lock and a zipper, wherein the zipper comprises a slider and a puller, the puller being provided on the slider, a first end of the slider is provided with a locking portion corresponding to the lock; and the lock comprises a lock hook pusher and a combination lock mechanism;

when in a locked state, the locking portion on the slider is inserted into the lock in a first direction and locked; and when in an unlocked state, the lock is unlocked by moving the lock hook pusher relative to the combination lock in a second direction perpendicular to the first direction, and the locking portion on the slider may be pulled out from the lock.

2. The luggage zipper lock according to claim 1, wherein the lock is a combination lock, which further comprises a locking/unlocking mechanism, and the locking/unlocking mechanism further comprises a lock case and at least one lock hook portion; wherein the lock case is provided with a lock hole and a combination lock hole that correspond to the lock hook portions, the lock hole being used for inserting the lock portion of the zipper, the combination lock mechanism being provided in the combination lock hole;

the lock hook pusher, the lock hook portions and the combination lock mechanism are all provided in the lock case;

the lock hook pusher is connected to the combination lock mechanism, and the combination lock mechanism controls a relative movement of the lock hook pusher in the lock case;

the lock hook pusher is connected to each of the lock hook portions for defining a relative movement of each of the lock hook portions in the lock case, and each of the lock hook portions is respectively used to limit the locking portion inserted into the lock hole;

when in the locked state, the combination lock mechanism controls the lock hook pusher to make the lock hook in a locked position by contacting the lock hook pusher with each of the lock hook portions, and each of the lock hook portions respectively limits the lock portion inserted into the lock case;

when in the unlocked state, a digital password of the combination lock mechanism is correct, the combination lock mechanism controls the lock hook pusher to move, and the moving lock hook pusher does not contact with each of the lock hook portions, so that each of the lock hook portions is in an unlocked position, and each of the lock hook portions does not limit the locking portion inserted into the lock case.

3. The luggage zipper lock according to claim 2, wherein the combination lock mechanism comprises a plurality of password disks, a plurality of password disk limit blocks, and a password disk shaft, wherein the password disk shaft is provided in the lock case; an inner ring of each of the plurality of password disks is connected correspondingly to a first end of each of the plurality of password disk limit blocks one by one, each of the plurality of password disks is fixed relative to the first end of each of the plurality of password disk limit blocks, and each of the plurality of password disks is provided with a plurality of grooves corresponding to numbers; each of the plurality of password disk limit blocks is opened with a through hole for the password disk shaft to pass through, and each of the plurality of password disk limit blocks is connected respectively to the password disk shaft through the through hole; each of the plurality of password disk limit blocks is provided with a notch;

the lock hook pusher is opened with a plurality of receiving holes for correspondingly receiving the plurality of password disks, each of the plurality of password disks penetrates through each of the plurality of receiving holes correspondingly, and the lock hook pusher is provided with a plurality of protrusions correspondingly, each of the plurality of protrusions of the lock hook pusher being capable of inserting into the notch on each of the plurality of password disk limit blocks correspondingly;

when in the unlocked state, the digital password of the combination lock mechanism is correct, the protrusions of the lock hook pusher are inserted into the notch on the password disk limit blocks, and the lock hook pusher is moved down.

4. The luggage zipper lock according to claim 2, wherein one end of the lock hook pusher is provided with the lock hook portion, or both ends of the lock hook pusher are provided relatively with the lock hook portion.

5. The luggage zipper lock according to claim 4, wherein the lock hook portion comprises a lock hook, an end of the lock hook facing the lock hook pusher is provided with a limit notch, and an end of the lock hook pusher facing the limit notch is provided with a limit rod corresponding to the limit notch; when in the locked state, the limit rod is engaged in the limit notch, and the lock hook pusher limits a movement of the lock hook.

6. The luggage zipper lock according to claim 5, wherein an end of the lock hook facing the lock hole is opened with a locking notch, and the lock hook is engaged in the locking portion through the locking notch to lock the slider.

7. The luggage zipper lock according to claim 6, wherein the look hook comprises a first locking block, a second locking block and a first transmission portion;

a first end of the first transmission portion is provided with the limit notch, and both sides of a second end of the first transmission portion are provided with a first slope and a second slope respectively; a first end of the first locking block is provided with a third slope corresponding to the first slope, a second end of the first locking block is provided with the locking notch for locking the locking portion, and the first locking block contacts with the first transmission portion through the first slope and the third slope; a first end of the second locking block is provided with a fourth slope corresponding to the second slope, a second end of the second locking block is provided with the locking notch for locking the locking portion, and the second locking block contacts with the first transmission portion through the second slope and the fourth slope.

8. The luggage zipper lock according to claim 5, wherein the lock hook portion further comprises a spring, which has a first end connected to the lock hook and a second end fixed in the lock case, and the spring is used to provide a locking force to the lock hook for locking the locking portion.

9. The luggage zipper lock according to claim 2, wherein the luggage zipper lock further comprises a customs lock, and the lock case is further provided with a customs lock hole; a lock core of the customs lock is provided in the customs lock hole, the lock core is connected to the lock hook pusher, and the lock core controls a relative movement of the look hook pusher in the lock case.

10. The luggage zipper lock according to claim 2, wherein the locking portion is a columnar protrusion provided at the first end of the slider; a first end of the locking portion is a spherical surface, and a second end of the locking portion is connected to the slider; the locking portion is provided with a locking groove corresponding to the lock hook portion.

11. A luggage, provided with the luggage zipper lock according to claim 1; the luggage zipper lock is provided on the luggage, so that the luggage is locked by inserting the locking portion on the slider into the lock and locking.

* * * * *